US009444131B2

(12) United States Patent
Uttermann et al.

(10) Patent No.: US 9,444,131 B2
(45) Date of Patent: Sep. 13, 2016

(54) ANTENNA, SHIELDING AND GROUNDING

(71) Applicant: Apple Inc., Cupertino, CA (US)

(72) Inventors: Erik A. Uttermann, San Francisco, CA (US); Jeremy C. Franklin, San Francisco, CA (US); Stephen C. McClure, San Francisco, CA (US); Sean S. Corbin, San Jose, CA (US); Qingxiang Li, Mountain View, CA (US); Rodney A. Gomez Angulo, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 245 days.

(21) Appl. No.: 14/195,974

(22) Filed: Mar. 4, 2014

(65) Prior Publication Data

US 2014/0185857 A1 Jul. 3, 2014

Related U.S. Application Data

(63) Continuation of application No. 13/018,184, filed on Jan. 31, 2011, now Pat. No. 8,665,160.

(51) Int. Cl.

| | |
|---|---|
| ***H01Q 1/24*** | (2006.01) |
| ***H01Q 1/42*** | (2006.01) |
| ***H04R 1/02*** | (2006.01) |

(52) U.S. Cl.

CPC ..... *H01Q 1/243* (2013.01); *H01Q 1/42* (2013.01); *H04R 1/028* (2013.01); *Y10T 29/49016* (2015.01); *Y10T 156/1089* (2015.01)

(58) Field of Classification Search

CPC ..... H01Q 1/243; H01Q 1/42; H04R 1/028; Y10T 156/1089; Y10T 29/49016

USPC ..... 343/702, 841, 846; 381/388

See application file for complete search history.

(56) References Cited

U.S. PATENT DOCUMENTS

| | | | |
|---|---|---|---|
| 1,576,645 | A | 3/1926 | Eskew et al. |
| 3,540,162 | A | 11/1970 | Blackmer et al. |
| 3,885,925 | A | 5/1975 | Tatar |
| 4,193,227 | A | 3/1980 | Uhtenwoldt |
| 4,492,059 | A | 1/1985 | Panetti |
| 4,574,527 | A | 3/1986 | Craxton |
| 4,800,686 | A | 1/1989 | Hirabayashi et al. |
| 4,977,709 | A | 12/1990 | Siden |

(Continued)

FOREIGN PATENT DOCUMENTS

| | | |
|---|---|---|
| CN | 101540451 | 9/2009 |
| CN | 201491423 | 5/2010 |

(Continued)

*Primary Examiner* — Hoanganh Le

(74) *Attorney, Agent, or Firm* — Brownstein Hyatt Farber Schreck, LLP

(57) ABSTRACT

A portable computing device is disclosed. The portable computing device can take many forms such as a laptop computer, a tablet computer, and so on. The portable computing device can include a single piece housing formed from a radio opaque material with a cover formed from a radio transparent material. To implement a wireless interface, an antenna stack-up can be provided that allows an antenna to be mounted to a bottom of the cover. Methods and apparatus are provided for improving wireless performance. For instance, in one embodiment, a metal housing can be thinned to improve antenna performance. As another example, a faraday cage can be formed around speaker drivers to improve antenna performance.

20 Claims, 16 Drawing Sheets

(56) References Cited

U.S. PATENT DOCUMENTS

| | | | |
|---|---|---|---|
| 5,033,237 | A | 7/1991 | Slough et al. |
| 5,231,587 | A | 7/1993 | Frost |
| 5,419,626 | A | 5/1995 | Crockett |
| 5,493,462 | A | 2/1996 | Peter |
| 5,662,515 | A | 9/1997 | Evensen |
| 5,865,668 | A | 2/1999 | Stewart |
| 5,895,311 | A | 4/1999 | Shiotani et al. |
| 6,266,019 | B1 | 7/2001 | Stewart et al. |
| 6,343,945 | B1 | 2/2002 | Liikanen |
| 6,490,435 | B1 | 12/2002 | Ma et al. |
| 6,560,092 | B2 | 5/2003 | Itou et al. |
| 6,729,893 | B2 | 5/2004 | Ezaki |
| 6,749,448 | B2 | 6/2004 | Bright et al. |
| 6,791,825 | B1 | 9/2004 | Taylor |
| 6,842,333 | B2 | 1/2005 | Lee et al. |
| 7,145,769 | B2 | 12/2006 | Chen |
| 7,232,181 | B2 | 6/2007 | Schmucker |
| 7,324,308 | B2 | 1/2008 | Kimura et al. |
| 7,331,793 | B2 | 2/2008 | Hernandez et al. |
| 7,390,242 | B2 | 6/2008 | Kim et al. |
| 7,494,305 | B2 | 2/2009 | Riall et al. |
| 7,633,747 | B2 | 12/2009 | Yang et al. |
| 7,652,877 | B2 | 1/2010 | Nishizawa |
| 7,697,281 | B2 | 4/2010 | Dabov et al. |
| 7,821,782 | B2 | 10/2010 | Doherty et al. |
| 7,839,658 | B2 | 11/2010 | Kim |
| 7,852,626 | B2 | 12/2010 | Eldershaw |
| 7,894,185 | B2 | 2/2011 | Weber et al. |
| 7,896,728 | B2 | 3/2011 | Schwartz |
| 7,921,553 | B2 | 4/2011 | Wojack et al. |
| 7,947,900 | B2 | 5/2011 | Cheng et al. |
| 7,971,464 | B2 | 7/2011 | Hachino et al. |
| D642,563 | S | 8/2011 | Akana et al. |
| 8,081,430 | B2 | 12/2011 | Weber et al. |
| 8,123,070 | B2 | 2/2012 | Lim |
| 8,260,377 | B2 | 9/2012 | Paleczny et al. |
| 8,305,741 | B2 | 11/2012 | Chatterjee |
| 8,345,410 | B2 | 1/2013 | Ternus et al. |
| 8,363,399 | B2 | 1/2013 | Sonehara et al. |
| 8,421,689 | B2 | 4/2013 | Schlub et al. |
| 8,430,256 | B2 | 4/2013 | Allore et al. |
| 8,537,543 | B2 | 9/2013 | Wang et al. |
| 9,317,243 | B2 * | 4/2016 | Becze ..... G06F 3/01 |
| 2002/0085342 | A1 | 7/2002 | Chen et al. |
| 2006/0111032 | A1 | 5/2006 | Weston et al. |
| 2007/0081303 | A1 | 4/2007 | Lam et al. |
| 2007/0157993 | A1 | 7/2007 | Yoon |
| 2009/0040703 | A1 | 2/2009 | Gotham et al. |
| 2009/0042495 | A1 | 2/2009 | Cho et al. |
| 2009/0094903 | A1 | 4/2009 | Choul et al. |
| 2009/0197116 | A1 | 8/2009 | Cheng et al. |
| 2009/0267677 | A1 | 10/2009 | Myers et al. |
| 2010/0008514 | A1 | 1/2010 | Bates et al. |
| 2010/0056231 | A1 | 3/2010 | Weiss et al. |
| 2010/0076583 | A1 | 3/2010 | Wojack et al. |
| 2010/0091442 | A1 | 4/2010 | Theobald et al. |
| 2010/0159803 | A1 | 6/2010 | Shore et al. |
| 2011/0007461 | A1 | 1/2011 | Moskowitz et al. |
| 2011/0189924 | A1 | 8/2011 | Erickson |
| 2011/0297578 | A1 | 12/2011 | Stiehl et al. |
| 2012/0061473 | A1 | 3/2012 | Forster et al. |
| 2012/0194393 | A1 | 8/2012 | Uttermann et al. |
| 2012/0194998 | A1 | 8/2012 | McClure et al. |
| 2013/0223836 | A1 | 8/2013 | Gibbs et al. |

FOREIGN PATENT DOCUMENTS

| | | |
|---|---|---|
| TW | 200616414 | 5/2006 |
| TW | M313872 | 6/2007 |
| TW | 200725979 | 7/2007 |
| WO | WO2009/126480 | 10/2009 |

* cited by examiner

ANTENNA, SHIELDING AND GROUNDING

CROSS-REFERENCE TO RELATED APPLICATIONS

This patent application is a continuation patent application of U.S. patent application Ser. No. 13/018,184, filed Jan. 31, 2011 and titled "Antenna, Shielding and Grounding," now U.S. Pat. No. 8,665,160, which is related to the following patent applications:

(i) U.S. Pat. No. 8,460,018, titled "Flat Object Ejector Assembly," by Jules Henry et al.;

(ii) U.S. patent application Ser. No. 13/018,174 titled "Handheld Portable Device," by Stephen R. McClure et al.;

(iii) U.S. Pat. No. 8,570,736, titled "Components Assembly," by Stephen R. McClure et al.;

(iv) U.S. patent application Ser. No. 13/018,242 titled "Machining Process and Tools," by Stephen R. McClure et al.

the disclosures of which are hereby incorporated by reference herein in their entireties.

BACKGROUND

The described embodiments relate generally to portable computing devices such as laptop computers, tablet computers, and the like. More particularly, antenna systems for portable computing devices and methods of assembling portable computing devices including the antenna systems are described.

From a visual stand point, users often find compact and sleek designs of consumer electronic devices more aesthetically appealing. As an example, portable electronic device designs that are both thin and light-weight are often popular with consumers. To enable this type of design, the portable electronic device can include a thin profile enclosure and a number of different components disposed inside. For instance, a display, a main logic board including a processor and memory, batteries, audio circuitry, speakers and external interface circuitry can be disposed within the thin-profile enclosure.

One advantage of a portable electronic device is that it can be transported to and utilized in a number of different environments. While being moved from environment to environment, external communications and data connectivity are desired. To meet this need, a common approach is to implement a wireless solution on the portable electronic device. The wireless solution can include implementing a wireless protocol and providing one or more antennas on the device.

A design objective for a wireless solution is consistent wireless performance under a wide range of operating conditions. One challenge to obtaining consistent wireless performance is that materials that are desirable for meeting an aspect of the over-all design different from the wireless performance can negatively affect its wireless performance. For instance, to meet strength and stiffness objectives, it may be desirable to use materials for the enclosure or the device components that are radio opaque and hence block antenna reception. Another challenge to obtaining consistent wireless performance is that, in a compact device with limited packaging space, components that can generate or that can be induced to generate signals that are detrimental to wireless performance can be packaged in close proximity to the antennas.

In view of the foregoing, there is a need for methods and apparatus for improving wireless performance in portable electronic devices.

SUMMARY

A portable computing device is disclosed. The portable computing device can take many forms such as a laptop computer, a tablet computer, and so on. A single piece housing including an integral bottom and side walls that cooperate to form an interior cavity can be used as an enclosure. Device components, such as a display, battery packs, a main logic board, memory, audio devices can be packaged within the interior cavity. The components can be sealed within the interior cavity using a cover. In one embodiment, the single piece housing can be formed from a radio opaque material and the cover can be formed from a radio transparent material that is also light transparent, such as a transparent glass.

An antenna system can be disposed within the interior cavity of the housing underneath the cover. The antenna system can include comprising an antenna for transmitting or receiving wireless signals. An adhesive layer for bonding the antenna to a bottom of the cover glass and a compressible foam layer can be provided. The compressible foam layer can be configured to exert an upward force on the antenna to provide a relatively constant spacing between the antenna and the bottom of the cover and to minimize air gaps between the bottom of the cover and the antenna. The relative constant spacing and the minimal air gaps may help to improve the performance of a wireless solution implemented using the antenna.

In one embodiment, the antenna can be bonded to the compressible foam layer. In another embodiment, an antenna carrier can be disposed between the antenna and the compressible foam layer where antenna and the compressible foam can each be bonded to the antenna carrier. An RF antenna window can be provided with the housing. In one embodiment, the antenna carrier can be configured to fit within the RF antenna window.

In another embodiment, a proximity sensor can be coupled to the antenna carrier, such as by bonding the proximity sensor the compressible foam layer. The proximity sensor can be used to detect objects near the antenna. When an object is detected near the antenna, a power level associated with the antenna can be adjusted. A shield can be disposed between the proximity sensor and the antenna. The shield can be used to prevent electromagnetic interference generated by the proximity sensor from reaching the antenna.

Another aspect of the invention provides a system. The system can include a metal housing having a surface for receiving a cover glass, a speaker assembly and an antenna system. The speaker assembly can have a) a speaker housing having a metal portion for enclosing at least one speaker driver; b) a connector for grounding the speaker drivers to the metal portion of the speaker housing; c) a conductive material wrapped around the speaker housing for forming a faraday cage around the at least one speaker driver, the conductive material grounded to the metal portion and the metal housing. The antenna system can be mounted to a bottom of the cover glass and to the speaker assembly. Further, the antenna system can be grounded to the metal housing. In one embodiment, the antenna system can be located near one side edge of the metal housing. The thickness of the metal housing on the side edge proximate to the antenna system can be thinned to a performance of the antenna system.

Another aspect relates to a method of assembling an electronic device having a housing and a cover glass. The method can bonding an adhesive layer to an antenna, coupling a compressible layer of foam to the antenna; and bonding the antenna to the bottom of the cover glass where the compressible foam layer is configured to exert an upward force to the antenna to provide a relatively constant spacing between the antenna and the bottom of the cover glass and to minimize air gaps between the bottom of the cover glass and the antenna.

BRIEF DESCRIPTION OF THE DRAWINGS

The embodiments will be readily understood by the following detailed description in conjunction with the accompanying drawings, wherein like reference numerals designate like structural elements, and in which.

DESCRIBED EMBODIMENTS

Figure 1A:
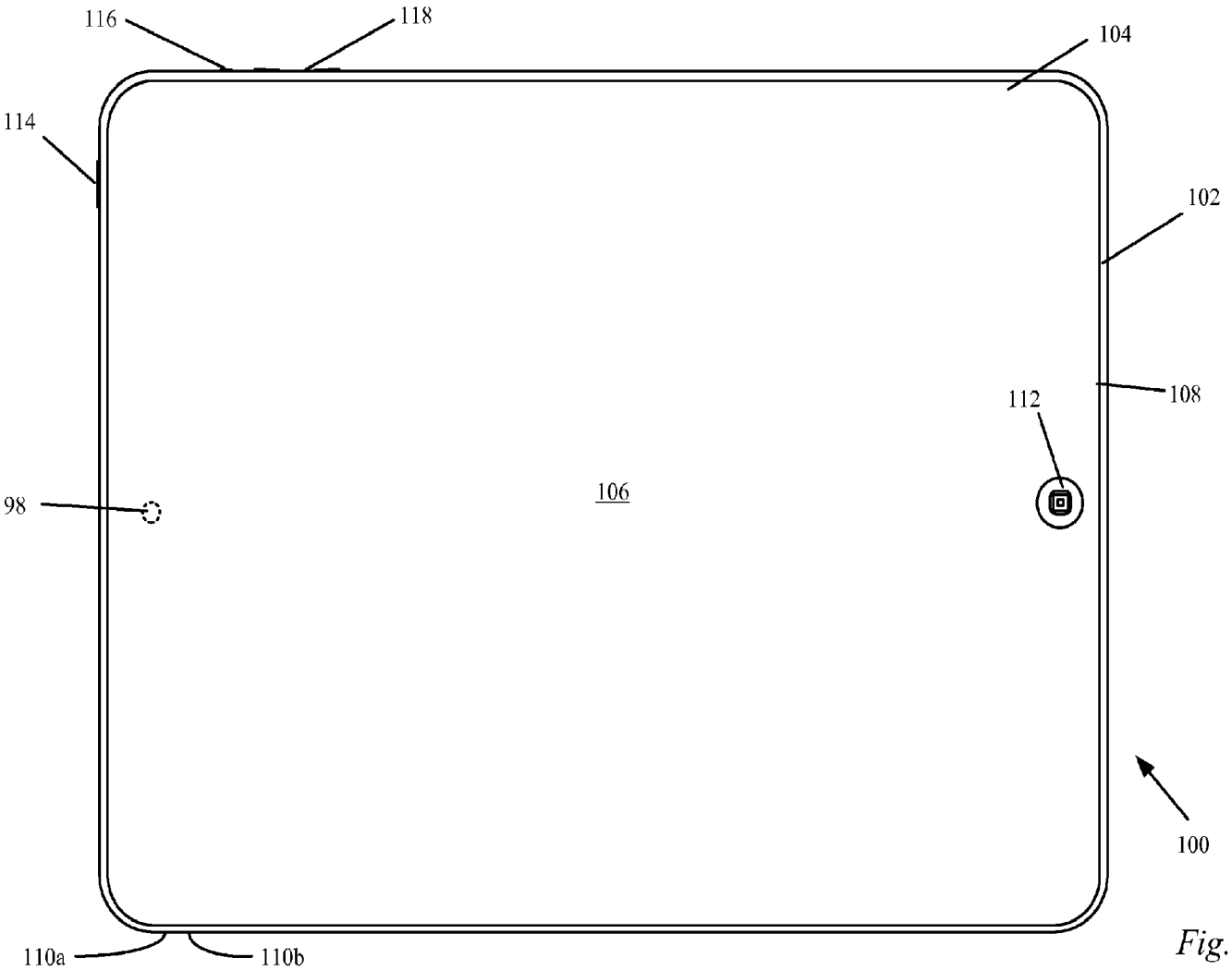
FIG. 1A shows a top view of a portable computing device in accordance with the described embodiments.

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

This paper discusses an aesthetically pleasing portable computing device that is easy to carry with one hand and operate with the other. A wireless solution can be implemented on the portable computing device. The wireless solution can involve implementing a wireless protocol and providing one or more antennas for receiving and transmitting wireless signals. The wireless solution can enable wireless communications with different wireless networks that the portable device encounters as it moved from location to location. In particular embodiments, antenna stack-ups, stack-up placement, housing and component designs are described that can be used to improve the wireless performance of the portable computing device.

The portable computing device can utilize a single piece housing and an aesthetically pleasing protective top layer that can be formed of any of a number of durable and strong yet transparent materials such as highly polished glass or plastic. For the remainder of this discussion, however, the protective top layer can take the form of highly polished cover glass without any loss in generality. The single piece housing can be used to enclose and protect various device components, such as a display assembly, main logic board, touch screen interface, batteries, memory, external interfaces, such as antennas used for wireless communications, and switches.

The single piece housing can be formed from plastic or metal. In the case where the single piece housing is formed of metal, a metal such as aluminum can be used. In one embodiment, the metal can be initially provided as a single billet that is subsequently machined. The single billet of material can be formed into a shape appropriate for housing various internal components as well as providing various openings into which switches, connectors, displays, and so on can be accommodated. In general, the single piece housing can be forged, molded, or otherwise processed into a desired shape.

One disadvantage of selecting a metal to use a housing material is that metals are generally opaque to radio signals. Thus, a selection of a metal material for the housing can affect antenna placement, i.e., the antennas need to be placed in a location of the housing where radio signals are not blocked by surrounding materials that are radio opaque. One of the advantages to using metal for the housing is ability of metal to provide good electrical grounding for any internal components requiring a good ground plane. For example, performance of a built in RF antenna can be substantially improved when a good ground plane is provided. Moreover, a good ground plane can be used to help mitigate the deleterious effects caused by, for example, of electromagnetic interference (EMI) and/or electrostatic discharge (ESD). However, if an RF antenna is present within the housing, a portion of the housing (if metal) may be given over to a radio transparent portion.

These and other embodiments are discussed below with reference to FIGS. 1A-11. However, those skilled in the art will readily appreciate that the detailed description given herein with respect to these figures is for explanatory purposes only and should not be construed as limiting.

Achieving a wireless solution that provides consistent wireless performance over a wide-range of operating conditions can involve considering the relative radio transparency or opacity of each the components of the portable device, the layout of the components relative to one another and an ability of each component to generate signals that can interfere with wireless reception. Thus, first, prior to describing particular features of the wireless solution, features of the portable computing device including features affecting the wireless solution are described in general with respect to FIGS. 1A-3C. Then, a more detailed discussion of apparatus and method associated with implementing the wireless solution are described with respect to FIGS. 4A-9B. Finally, the operation of a portable computing device that can incorporate one or more embodiments of the apparatus and the methods, described herein is described, with respect to FIGS. 10 and 11.

FIG. 1A illustrates a specific embodiment of portable computing device 100. More specifically, FIG. 1A shows a full top view of fully assembled portable computing device 100. Portable computing device 100 can process data and more particularly media data such as audio, video, images, etc. By way of example, portable computing device 100 can generally correspond to a device that can perform as a music player, game player, video player, personal digital assistant (PDA), tablet computer and/or the like. With regards to being handheld, portable computing device 100 can be held in one hand by a user while being operated by the user's other hand (i.e., no reference surface such as a desktop is needed). For example, the user can hold portable computing device 100 in one hand and operate portable computing device 100 with the other hand by, for example, operating a volume switch, a hold switch, or by providing inputs to a touch sensitive surface such as a display or pad. The device can also be operated while it is resting on a surface, such as a table.

Portable computing device 100 can include a single piece housing 102 that can be formed from any number of materials such as plastic or metal which can be forged, molded, machined or otherwise processed into a desired shape. In those cases where portable computing device 100 has a metal housing and incorporates RF based functionality, it may be advantageous to provide at least a portion of housing 102 in the form of radio (or RF) transparent materials such as ceramic, or plastic. An example of a housing including radio transparent portion is described in more detail with respect to FIGS. 3B and 3C. In other embodiments, it may be advantageous to place an antenna in a location where the amount of metal has been minimized. Details of such an antenna placement are described with respect to FIGS. 6A and 6B.

Returning to FIG. 1A, housing 102 can be configured to at least partially enclose any suitable number of internal components associated with the portable computing device 100. For example, housing 102 can enclose and support internally various structural and electrical components (including integrated circuit chips and other circuitry) to provide computing operations for portable computing device. The integrated circuits can take the form of chips, chip sets, modules any of which can be surface mounted to a printed circuit board, or PCB, or other support structure. For example, a main logic board (MLB) can have integrated circuits mounted thereon that can include at least a microprocessor, semi-conductor (such as FLASH) memory, various support circuits and so on.

Housing 102 can include opening 104 for placing internal components and may be sized to accommodate a display assembly or system suitable for providing a user with at least visual content as for example via a display. In some cases, the display system can include touch sensitive capabilities providing the user with the ability to provide tactile inputs to portable computing device 100 using touch inputs. The touch sensitive capabilities can generate signals that can interfere with wireless performance unless the touch sensor is well-grounded. A display-stack up including touch capabilities and a grounding scheme for the touch sensor is described with respect to FIG. 8.

Figure 5:
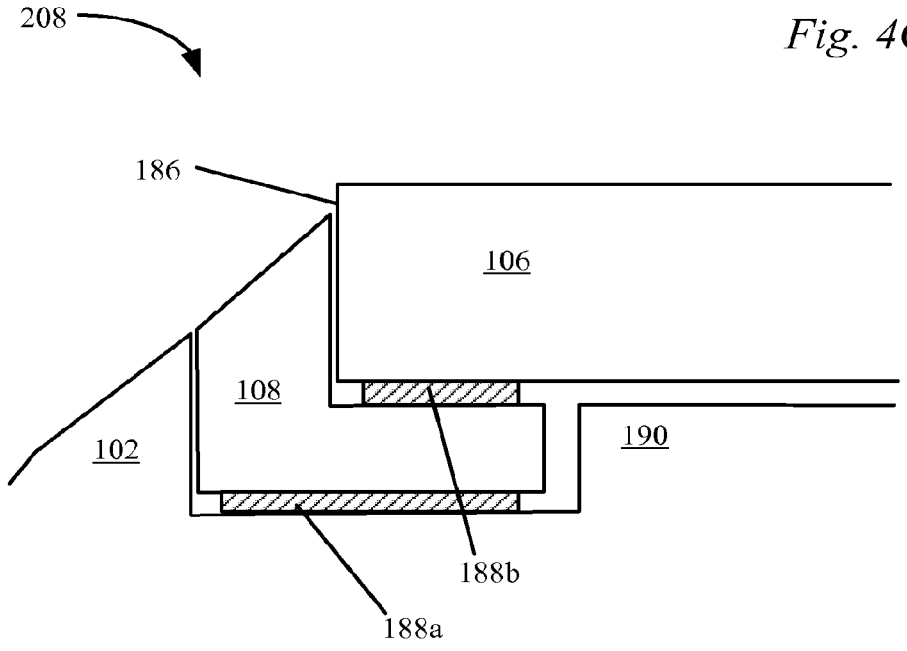
FIG. 5 shows a side view of a stack-up for bonding a cover to the housing.
Figure 6A:
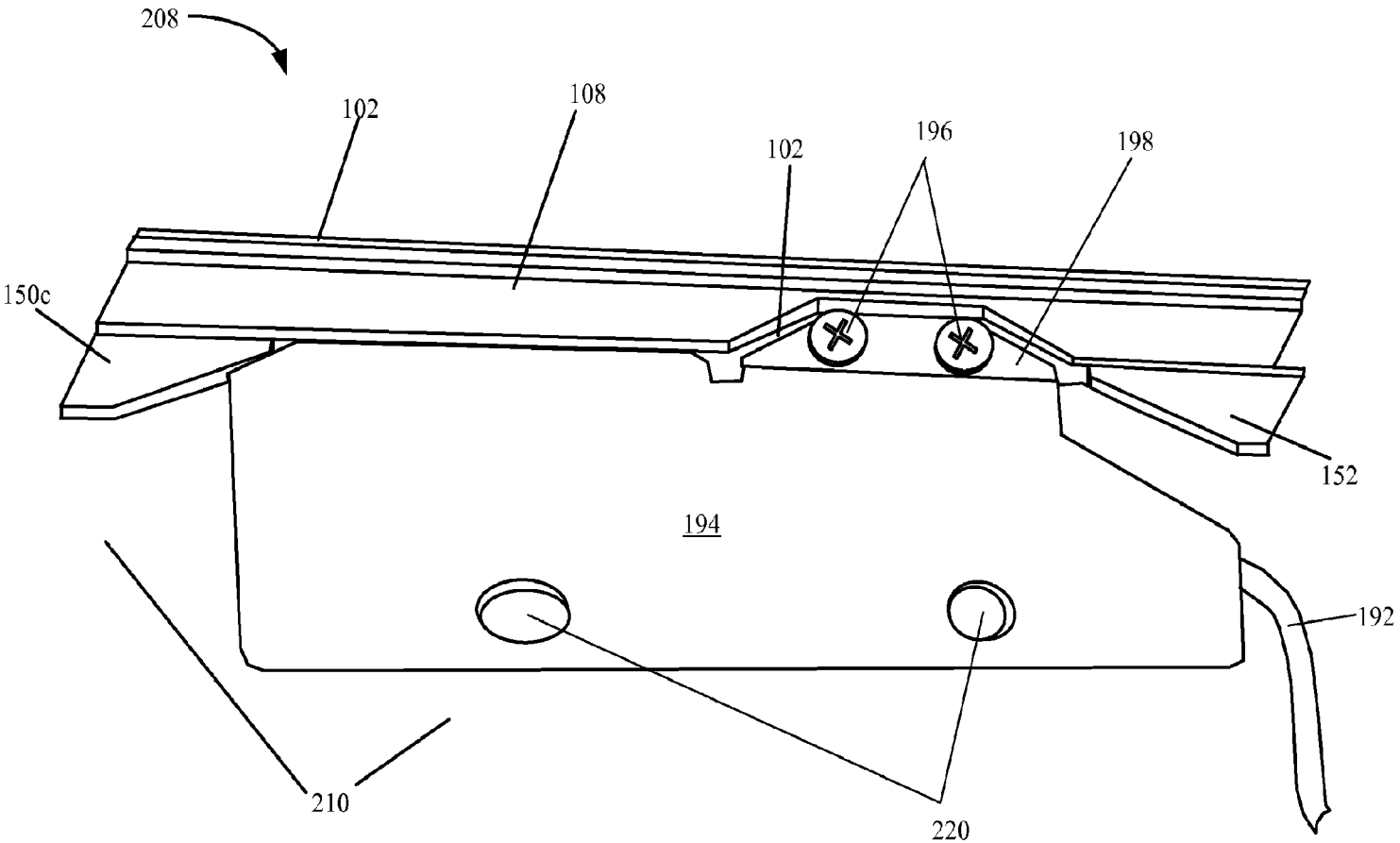
FIGS. 6A and 6B show perspective views an antenna stack-up located near an outer edge of a housing in accordance with the described embodiments.

The display system can be formed and installed separately from a cover 106. In particular embodiments, the cover 106 can take the form of cover glass substantially filling opening 104. Trim bead 108 can be used to form a gasket between cover glass 106 and housing 102. Trim bead 108 can be formed of a resilient material such as a plastic along the lines of thermoplastic urethane or TPU. In this way, trim bead 108 can provide protection against environmental contaminants from entering the interior of portable computing device 100. FIGS. 5 and 6A some of the possible configurations of the trim bead 108 relative to the cover 106 and the housing 102.

The cover 106 can be formed of polycarbonate or other appropriate plastic or highly polished glass. Typically, these materials can be made to be radio transparent. Thus, in some embodiments, it can be advantageous to locate antennas close to the cover 106. Various antenna stack-ups that can be used for mounting an antenna close to the cover glass 106 are described in more detail with respect to FIGS. 4A-4C.

Although not shown, the display panel underlying cover glass 106 can be used to display images using any suitable display technology, such as LCD, LED, OLED, electronic or e-inks, and so on. The display can present visual content that can include video, still images, as well as icons such as graphical user interface (GUI) that can provide information the user (e.g., text, objects, graphics) as well as receive user provided inputs. In some cases, displayed icons can be moved by a user to a more convenient location on the display. For example, GUI can be moved by the user manually dragging GUI from one location to a more convenient location. The display can also provide a user with tactile feedback provided by a number of haptic actuators usually, but not always, arranged in an array of haptic actuators incorporated into the display. In this way, the haptic actuators can provide the user with tactile feedback.

In one embodiment, the display assembly and cover glass can be provided as an integrated unit for installation into the housing. In another embodiment, the display assembly and the cover glass 106 can be installed separately. Display assembly may be placed and secured within the cavity using a variety of mechanisms. In one embodiment, the display assembly and the housing 102 can include alignment points for receiving a fixture. The fixture can be used to accurately align the display assembly with the housing. Then, after the display assembly is aligned with the housing, it can be secured to the housing 102 using fasteners.

Portable computing device 100 can include a number of mechanical controls for controlling or otherwise modifying certain functions of portable computing device 100. For example, power switch 114 can be used to manually power on or power off portable computing device 100. A slider switch 116 can be provided for controlling one or more different functions of the portable computing device. In one embodiment, the slider switch 116 can be used to provide a muting feature where the button 116 can be used to mute any audio output provided by portable computing device 100. The volume switch 118 can be used to increase/decrease volume of the audio output by portable computing device 100. It should be noted that each of the above described input mechanisms are typically disposed through an opening in housing 102 such that they can couple to internal components. In some embodiments, portable computing device 100 can include an image capture module 98 configured to provide still or video images. The placement may be widely varied and may include one or more locations including for example front and back of the device, i.e., one for capturing images through the back housing, the other for capturing images through the cover glass.

As described above, the portable computing device 100 can include a mechanism for wireless communications. As either a transceiver type device or receiver only, such as a radio, portable computing device 100 can include an antenna that can be disposed internal to a radio transparent portion of housing 102. In other embodiments, a portion of housing 102 can be replaced with radio transparent material in the form of an antenna window described in more detail below. In some embodiments, an antenna can be attached to an underside of the cover glass 106. The radio transparent material can include, for example, plastic, ceramic, and so on. The wireless communications can be based on many different wireless protocols including for example 3G, 2G, Bluetooth, RF, 802.11, FM, AM, and so on. Any number of antennas may be used, which can use a single window or multiple windows depending on the needs of the system. In particular embodiments, one or more the antennas can be configured to receive GPS signals. The GPS signals can be processed by the portable computing device 100 to determine a proximate location of the device.

The portable computing device can be used on a wireless data network, such as a cellular data network. Access to the cellular data network can require the use of a Subscriber Identity Module (SIM) or SIM card. In one embodiment, the device 100 can include an opening 110*b* that allows a SIM card to inserted or removed. In a particular embodiment, the SIM card can be carried on a SIM card tray that can extend from a side of the housing 102. The housing can include an opening 110*a* that allows an ejector for the SIM card tray to be actuated such that the SIM card tray is extended from the housing. The openings, 110*a* and 110*b*, for the SIM card tray are shown in FIG. 3B.

Figure 1B:
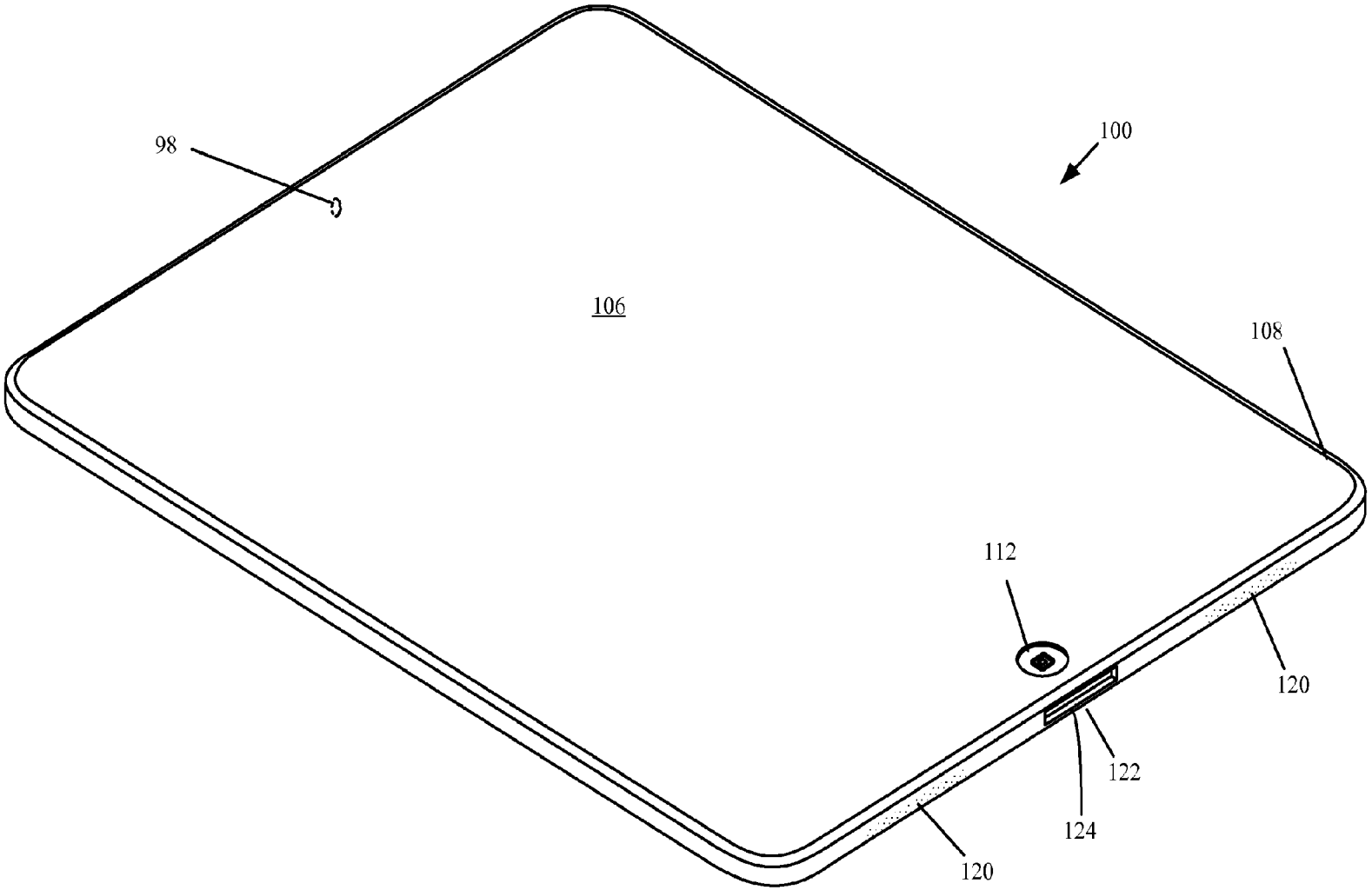
FIG. 1B shows a perspective top view of a portable computing device in accordance with the described embodiments.

FIG. 1B shows a perspective top view of portable computing device 100 in accordance with the described embodiments. As shown in FIG. 1B, portable computing device 100 can include one or more speakers used to output audible sound. The sounds generated by the one or more internal speakers can pass through the housing 102 via speaker grill 120. In one embodiment, the speaker grill 120 can be formed as a number of small openings machined into the housing 102.

In a particular embodiment, an antenna stack-up can be mounted to the top of a speaker assembly that is mounted in the housing 102 proximate to the speaker grill 120. A faraday cage can be formed around the speaker assembly to shield the antenna from EMI generated by the speaker. In one embodiment, the faraday cage can be formed by wrapping conductive tape on and around the speaker(s) in the speaker assembly. The conductive tape can serve multiple purposes. The conductive tape can be used to 1) shield the antenna(s) from EMI, 2) provide a constant ground plane between the antenna(s) and any variation in the position, size and shape of the metal components and 3) fill gaps and openings between the metal objects that could resonate at radio frequencies and reduce antenna performance. Details of this embodiment are described below with FIGS. 4C and 7.

The portable computing device 100 can also include one or more connectors for transferring data and/or power to and from portable computing device 100. For example, portable computing device 100 can include multiple data ports, one for each configuration of portrait mode and landscape mode. However, the currently described embodiment includes single data port 122 that can be formed of connector assembly 124 accommodated within an opening formed along a first side of housing 102. In this way, portable computing device 100 can use data port 122 to communicate with external devices when portable computing device 100 is mounted in docking station. It should be noted that in some cases, portable computing device 100 can include an orientation sensor or an accelerometer that can sense the orientation or movement of portable computing device 100. The sensor can then provide an appropriate signal which will then cause portable computing device 100 to present visual content in an appropriate orientation.

Connector assembly 124 can be any size deemed appropriate such as, for example, a 30 pin connector. In some cases, the connector assembly 124 can serve as both a data and power port thus obviating the need for a separate power connector. Connector assembly 124 can be widely varied. In one embodiment, connector assembly 124 can take the form of a peripheral bus connector. These types of connectors include both power and data functionality, thereby allowing both power delivery and data communications to occur between the portable computing device 100 and the host device when the portable computing device 100 is connected to the host device. In some cases, the host device can provide power to the media portable computing device 100 that can be used to operate the portable computing device 100 and/or charge a battery included therein concurrently with the operating.

Figure 2:
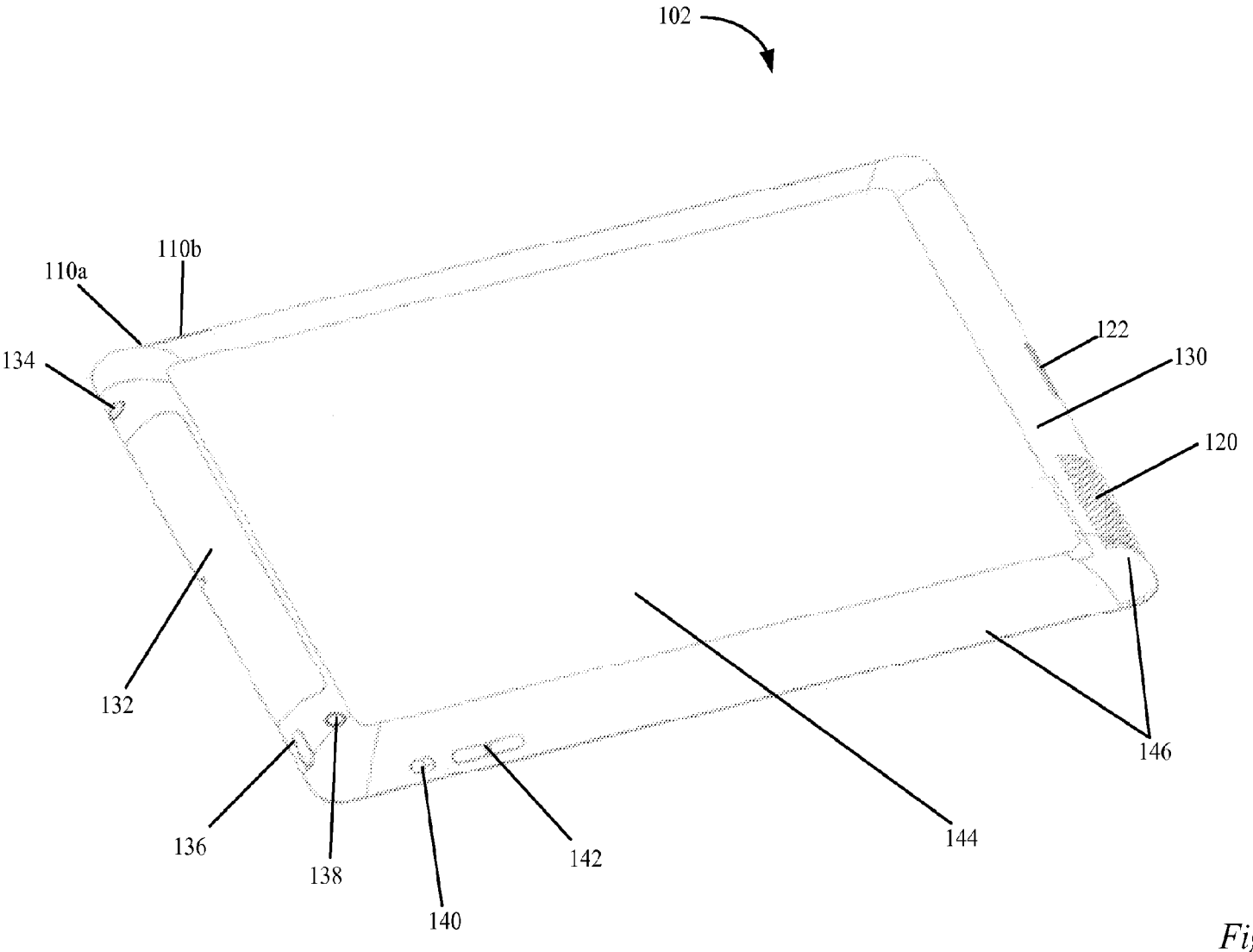
FIG. 2 shows a perspective view of an exterior portion of a housing in accordance with the described embodiments.

FIG. 2 shows a perspective view of an exterior portion of a housing 102 prior to assembly. The exterior portion can act as a bottom portion of the device after assembly. An interior portion of the housing and its associated features, which encloses device components such as a display assembly and main logic board, is described with respect to FIG. 3B. In one embodiment, the housing can be formed via machining of a single billet of material, such as a single billet of aluminum. In FIG. 2, a portion of the billet can have been machined to form the general outer shape of the exterior portion of the housing. In other embodiments, the billet can be cast into some shape that is closer to the final shape of the housing prior to beginning machining to produce the final housing shape.

The housing 102 includes a substantially flat portion 144 surrounded by curved side walls 146. In one embodiment, the housing 102 can have a maximum thickness of less than 1 cm. In a particular embodiment, the maximum thickness is about 8 mm. In FIG. 2, the geometry is provided for the purposes of illustration only. In different embodiments, the curvature on the side walls, such as 146, and the area of the flat portion 144 can be varied. In one embodiment, rather than a flat portion joined by curved side walls, the sidewalls and flat portion can be combined into a shape with a continuous profile, such as conforming to a continuous spline curve. In yet other embodiments, rather than using curved side walls, the side walls can be substantially flat and joined to the substantially flat portion via a specified radius of curvature.

Openings can be formed in the flat portion 144 and the sidewalls 146. The openings can be used for various purposes that involve functional as wells as cosmetic considerations. In one example, the openings can be used for switches. As shown in FIG. 2, a number of switch openings are formed in the side walls. For instance, opening 136 is for a power control switch, opening 140 is for a slider switch and opening 142 is for a volume switch. The size of the openings can depend on the size of the switch. For example, opening 142 can be for a volume rocker switch which can be larger than a power control switch or the slider switch.

In another example, openings can be formed in the housing for external connectors. For example, an opening 134 is provided in the side wall for an audio port, such as for a head phone connector. In yet another example (see FIG. 1B and FIG. 3B), an opening can be provided for an external data and power connector, such as a 30-pin connector. Closer to the substantially flat portion of the housing 144, opening 138 can be provided for a rear facing image capture device.

The housing 102 can be formed from a radio opaque material, such as a metal. In a particular embodiment, the housing can include a cut-out portion for placement of an RF antenna window. One or more antenna can be placed in the RF antenna window. The housing can include a cut-out for receiving the RF antenna window 132. The RF antenna window can be formed from a radio transparent material, such as a plastic, to improve wireless data reception for the device. In FIG. 2, the RF antenna window is shown an installed position extending across the side wall and ending proximate to the substantially flat portion 144 of the housing. The RF antenna window 132 can be shaped to match the surface curvature profiles of the adjacent sidewalls. A more detailed view of the RF antenna window 132 and surrounding support structure on the housing are described in more detail with respect to FIGS. 3B and 3C.

In particular embodiments, a device can be configured to access a data network via one or more wireless protocols. For example, using a protocol such as Wi-Fi, a device can be configured to access the Internet via a wireless access point. As another example, using a wireless protocol, such as GSM or CDMA, device can be configured to access a cellular data network via a local cell phone tower. A device implementing two wireless protocols, such as Wi-Fi and GSM or Wi-Fi and CDMA, can employ different antenna system, one for the Wi-Fi and one for the GSM or CDMA. In addition, one or more of the antenna systems can also be used to receive GPS signals that can be used to determine a proximate location of the device.

Typically, a component, such as the RF antenna window 132, can be used to implement a cellular data network connection using GSM or CDMA. To implement a wireless protocol, such as Wi-Fi, the RF antenna window 132 may not be necessary. Thus, in some embodiments, a housing can be formed without an opening for the RF antenna window 132. As an example, the antenna stack-up in FIG. 4C can be used without the RF antenna window 132.

In embodiments where an RF antenna window, such as 132, is not used, the housing 102 can extend over the surface where RF antenna window 132 is located in FIG. 2 to conform to the surrounding curvature of the sidewall. Thus, the area where the RF antenna window 132 is located can be formed from the same material as the other portions of the housing 102 and machined in a manner similar to the other sidewalls of the housing.

Figure 3A:
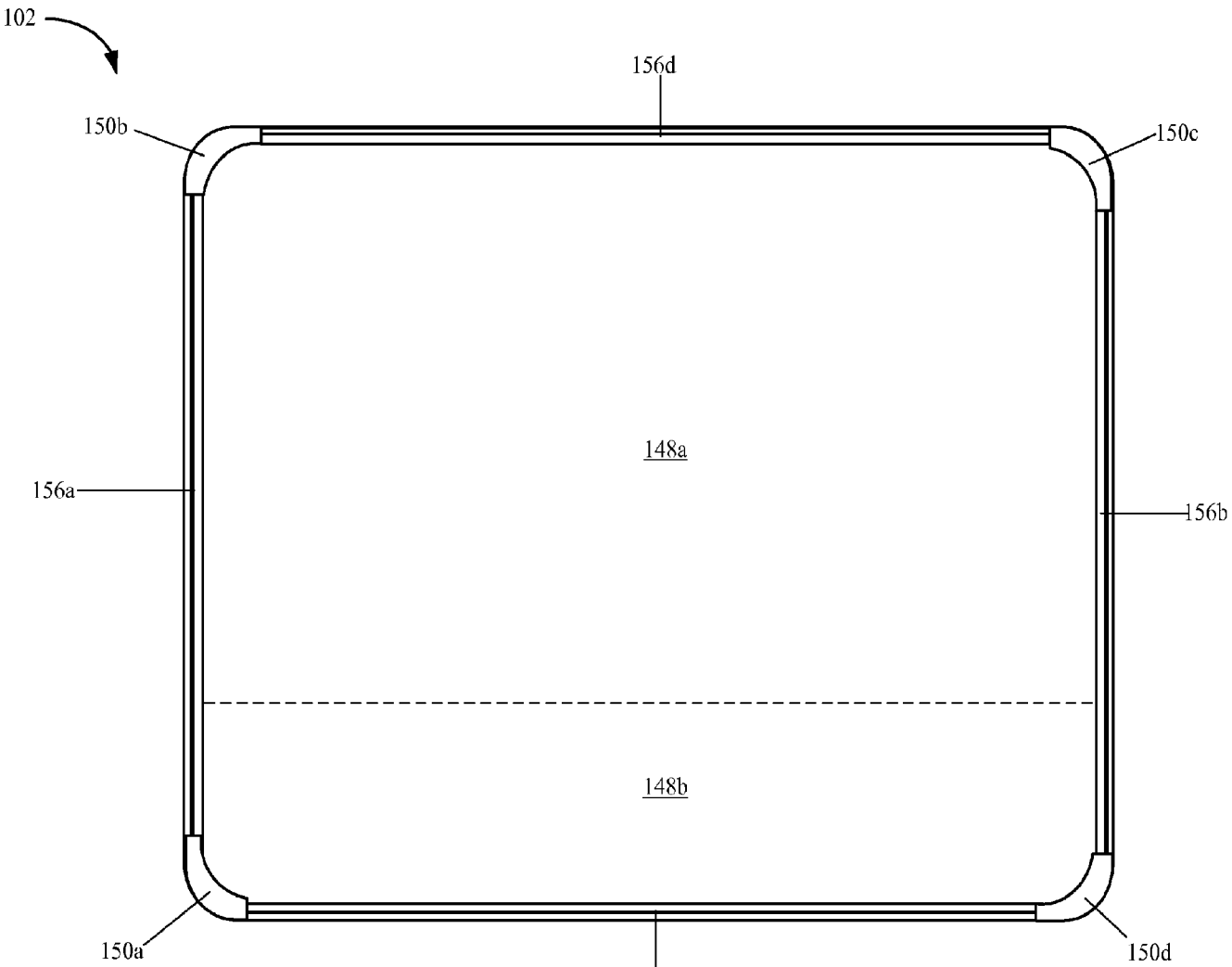
FIG. 3A shows a simplified top view of the interior of the housing in accordance with the described embodiments.
Figure 3B:
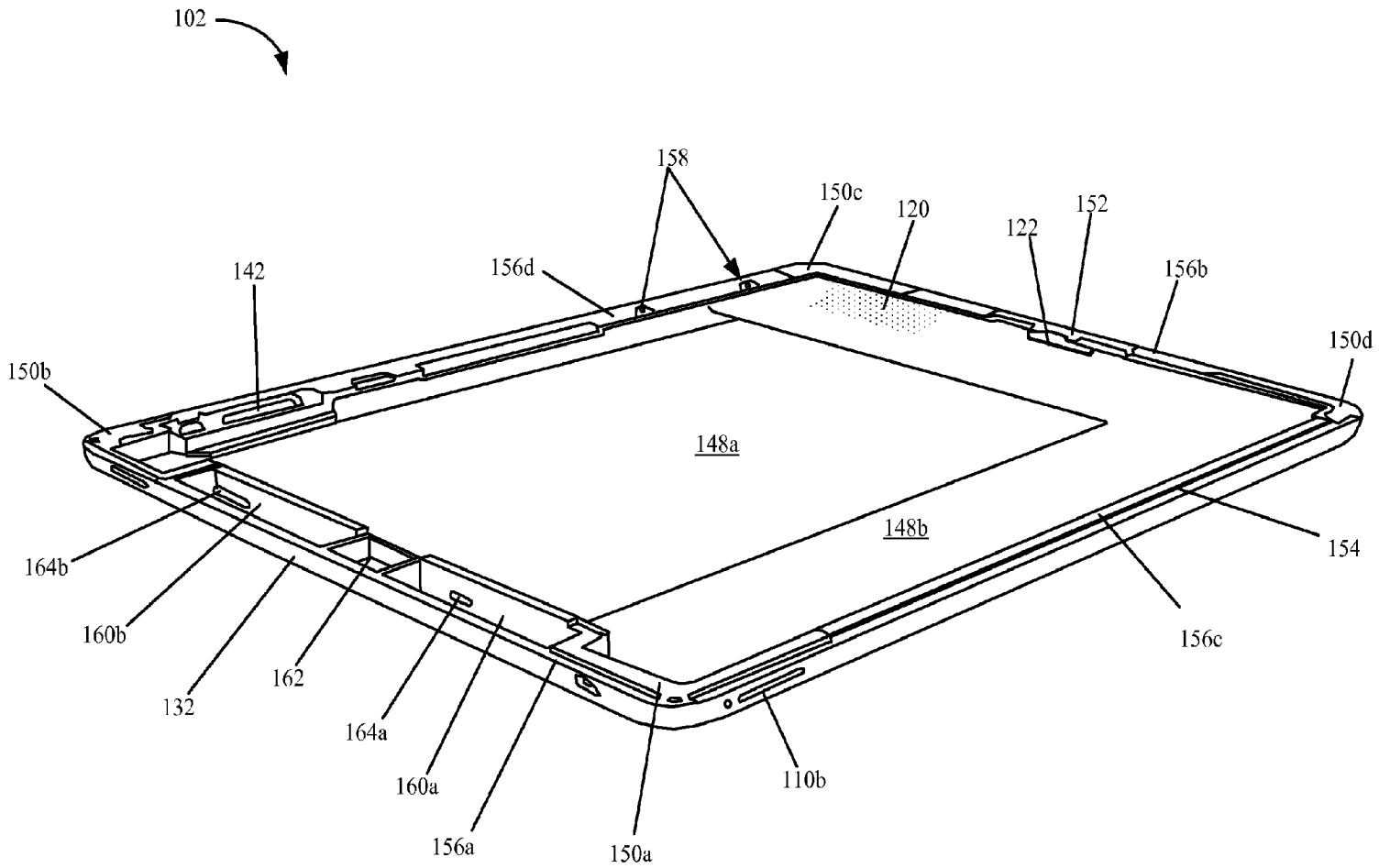
FIG. 3B shows a perspective view of an interior portion of a housing in accordance with the described embodiments.

FIG. 3A shows a top view of a simplified housing 102 showing a cavity with a front opening for one embodiment. A more detailed perspective view of a housing is described with respect to FIG. 3B. In 3A, the housing 102 can include substantially flat bottom portions 148*a* and 148*b*. The flat bottom portions, 148*a* and 148*b*, can be at different heights or a single height. In one embodiment, the flat bottom portions, 148 and 148*b*, can be substantially parallel with the flat exterior bottom 144 of the housing described above with respect to FIG. 2. The flat bottom portions, 148*a* and 148*b*, can transition into sidewalls that extend above the bottom of the cavity.

The sidewalls can be undercut to form ledges, such as ledges 156*a*, 156*b*, 156*c* and 156*d* that extend into the center of the cavity from the sidewalls. In one embodiment, the ledges can include portions at different heights. The width of the ledges can vary across each side and vary from side to side. For instance, the width of the ledge 156*a* can be thinner than ledge 156*d*.

Brackets, such as 150*a*, 150*b*, 150*c* and 150*d*, can be placed at each corner of the housing. The brackets can be formed from a metal, such as stainless steel. The brackets can be configured to add structural stiffness to the housing. During an impact event, such as an impact to the corner of the housing, the corner brackets can limit the amount of impact damage, such as damage to a cover glass. To prevent degradation in the wireless performance, the brackets can be grounded to the housing 102 using an open cell conductive foam.

In one embodiment, components, such as the batteries, can be disposed within regions 148*a* and 148*b*. For instance, in one embodiment, a number of battery packs can be bonded using PSA strips to the housing in region 148*a*. In one embodiment, three battery packs can be adhered to flat region 148*a* using adhesive that can take the form of adhesive strips such as PSA. Using adhesive strips can slightly elevate the batteries and provide room for the batteries packs to expand during operation. As another example, in region 148*b*, a number of PCBs can be placed. The number and type of PCBs can vary from embodiment to embodiment depending on the functionality of the device. A few examples of PCBs that can be secured to the housing in this region include but are not limited to a main logic board, a battery management unit, and/or a RF circuit board. The RF circuit board can also include GPS circuitry.

FIG. 3B shows a perspective view of an interior portion of a housing 102 that can be formed using a CNC based machining process. The exterior portion of the housing 102 can also be formed using a CNC based machining process. Device components, such as a display, processor boards, memory, and audio devices can be secured within a cavity formed by the housing. It should be noted that throughout the following discussion, the term "CNC" is used. The abbreviation CNC stands for computer numerical control and refers specifically to a computer controller that reads computer instructions and drives a machine tool (a powered mechanical device typically used to fabricate components by the selective removal of material). It should be noted however, that any appropriate machining operation can be used to implement the described embodiments and is not strictly limited to those practices associated with CNC.

In the embodiment in FIG. 3B, the housing 102 includes a cut-out for the RF antenna window 132. The antenna window 132 can include a number cavities, such as 162, 160*a* and 160*b*. In one embodiment, cavities 160*a* and 160*b* can be configured to receive an antenna carrier that includes an antenna. One embodiment of a stack-up for the antenna carrier is described with respect to FIGS. 4A and 4B. Cavity 162 can be used to receive a camera assembly.

The antenna window can include openings, such as 164*a* and 164*b*, that are aligned with openings in the housing 102 that allow wiring to extend from an interior of the housing to the RF antenna window. For instance, the wiring can extend from the antennas to allow a communication connection to be established with the main logic board. The openings in the housing 102 that can allow connections into the antenna window 132 are shown in FIG. 3C.

The housing 102 can include a number of features adjacent to the sidewalls of the housing and arranged around a perimeter of the housing. For instance, speaker holes 120 can be machined into one of the sidewalls. In one embodiment, a speaker assembly can be mounted proximate to the speaker holes 120 where an antenna is mounted on top of the speaker assembly. The speaker can be coupled to the housing via attachment points 158. As is described in more detail with respect to FIGS. 6A and 6B, the antenna can be positioned near a strengthening bracket 152 located over the data port 122 where the housing proximate to the antenna on the adjacent sidewall is thinned to improve the wireless performance of the antenna.

In this embodiment, the antenna mounted on top of the speaker assembly can be bonded to a bottom of the cover glass. A mechanism such as a compressible foam can be used to press the antenna against the bottom of the cover glass to help to form a good seal between the cover glass and the antenna during the bonding process. Prior to bonding the antenna to the bottom of the cover glass, the antenna and the cover glass can be aligned with one another. The speaker assembly can be mounted on features within the interior of the housing 102 that are well controlled relative to the glass mounting surface so that the foam compliance needed to align the antenna to the glass is minimized.

Figure 3C:
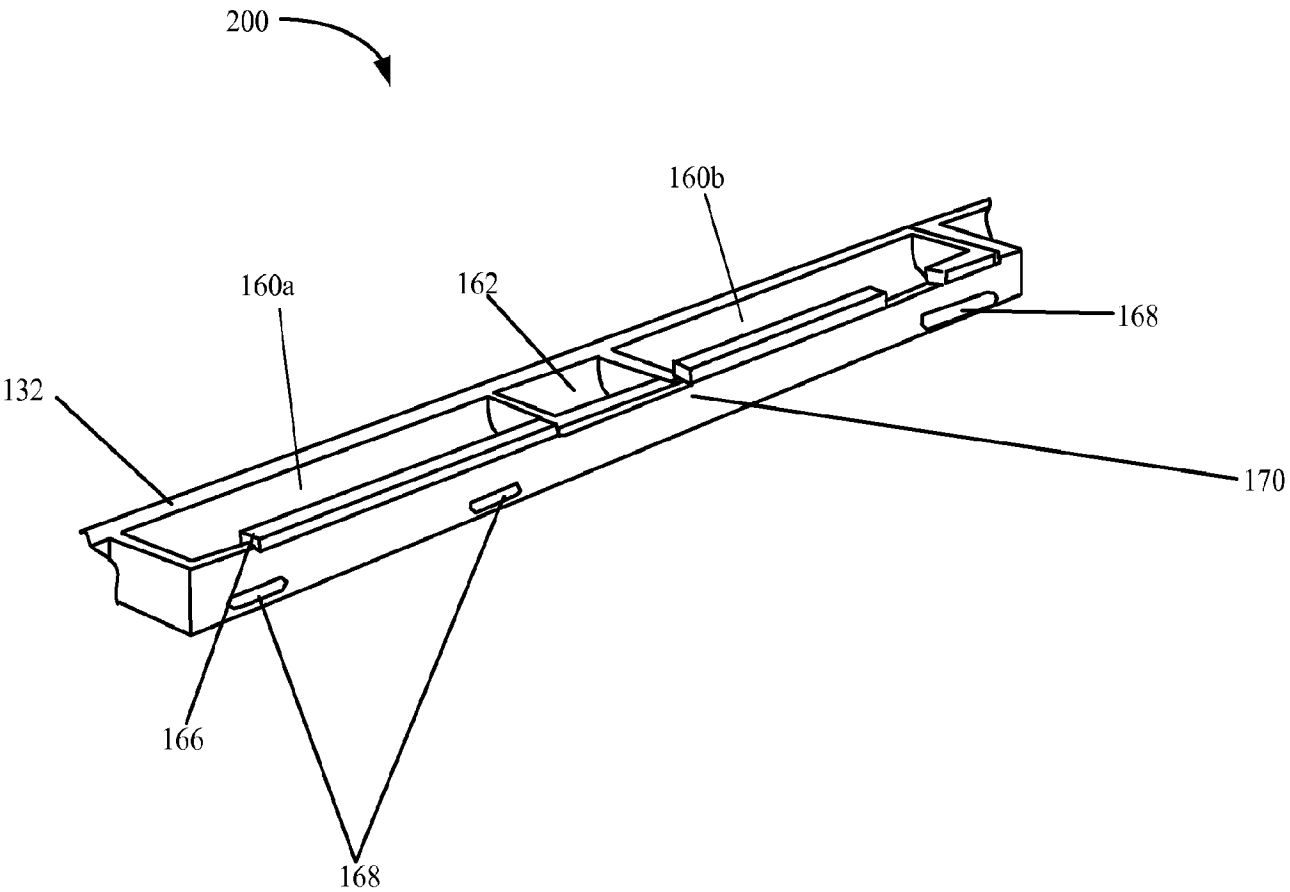
FIG. 3C shows a perspective view of an antenna window mounted to a housing in accordance with the described embodiments.

FIG. 3C shows a perspective view 200 of an antenna window 132 mounted to the housing 102 from a different view than shown with respect to FIG. 3B. As describe above, the RF antenna window can be configured to support one or more antenna carriers within cavities of the window. As described above, the RF antenna window 132 can optionally include a cavity 162 for supporting an image capture device and/or sensor assembly.

The housing 102 can include a recessed portion in which the RF antenna window 132 is disposed. In one embodiment, the antenna window 132 can be supported by the support wall 170 formed in the housing 102. The RF antenna window 132 can include a lip portion 166 that hangs over the support wall 170. The lip portion 166 can help to prevent the antenna tray from being pulled out of the housing. The RF antenna window 132 can be bonded to the housing an adhesive, such as an epoxy or a PSA tape. The antenna tray 132 can be bonded along the lip portion and exterior facing surfaces of the support wall 170.

The support wall 170 can include a number of openings, such as openings 168. The openings 168 can be aligned with openings in the RF antenna window 132. The openings can allow wires to be passed through the housing and into the antenna carrier to reach components in the RF antenna window 132, such as one or more antennas and the image capture and/or sensor assembly. In alternate embodiments, an RF antenna window 132 and its associated antennas can be removed. In this embodiment, the support wall 170 can be removed and the exterior and interior portions of the housing proximate to the antenna location can be formed from the same material as the remaining portions of the housing.

Figure 4A:
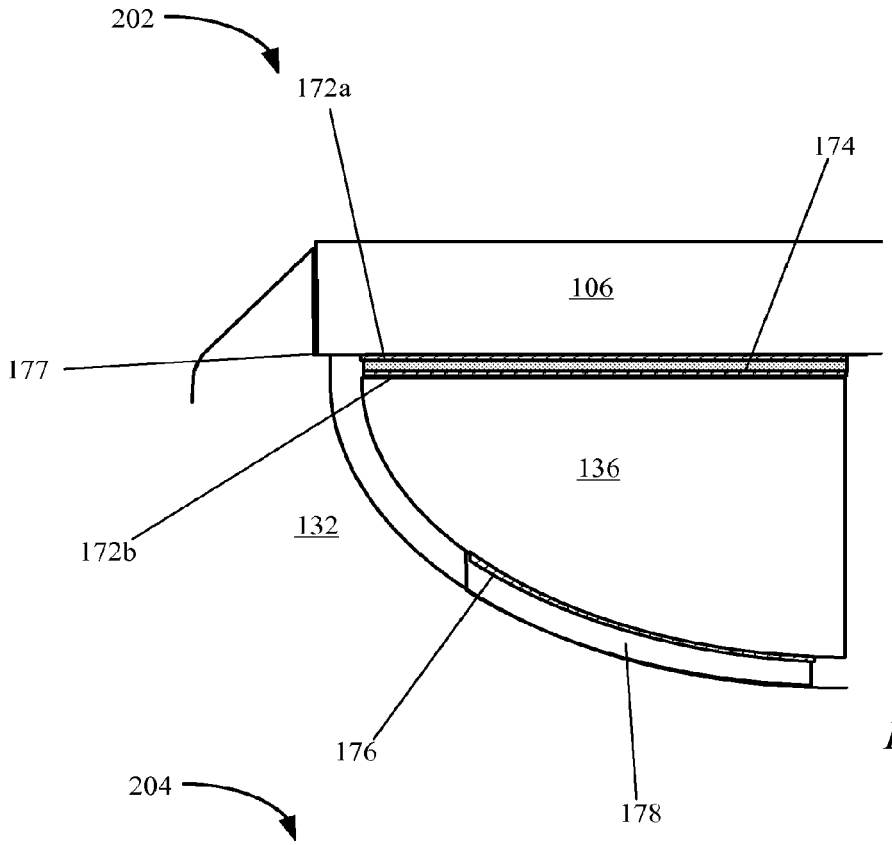
FIGS. 4A-4C show side views of antenna stack-ups in accordance with the preferred embodiments.
Figure 4B:
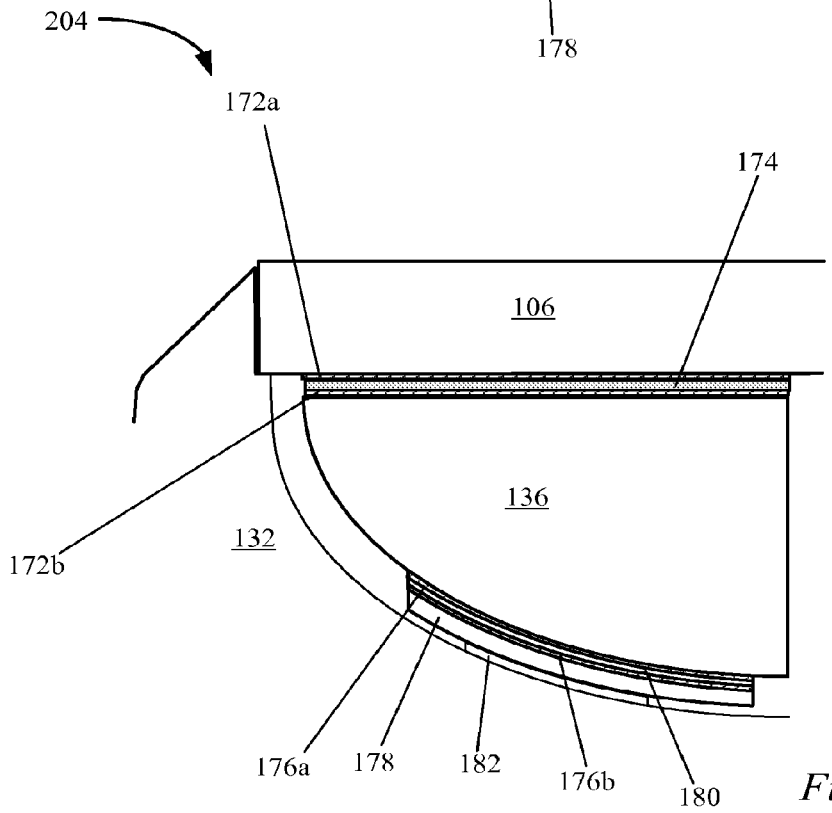
Figure 4C:
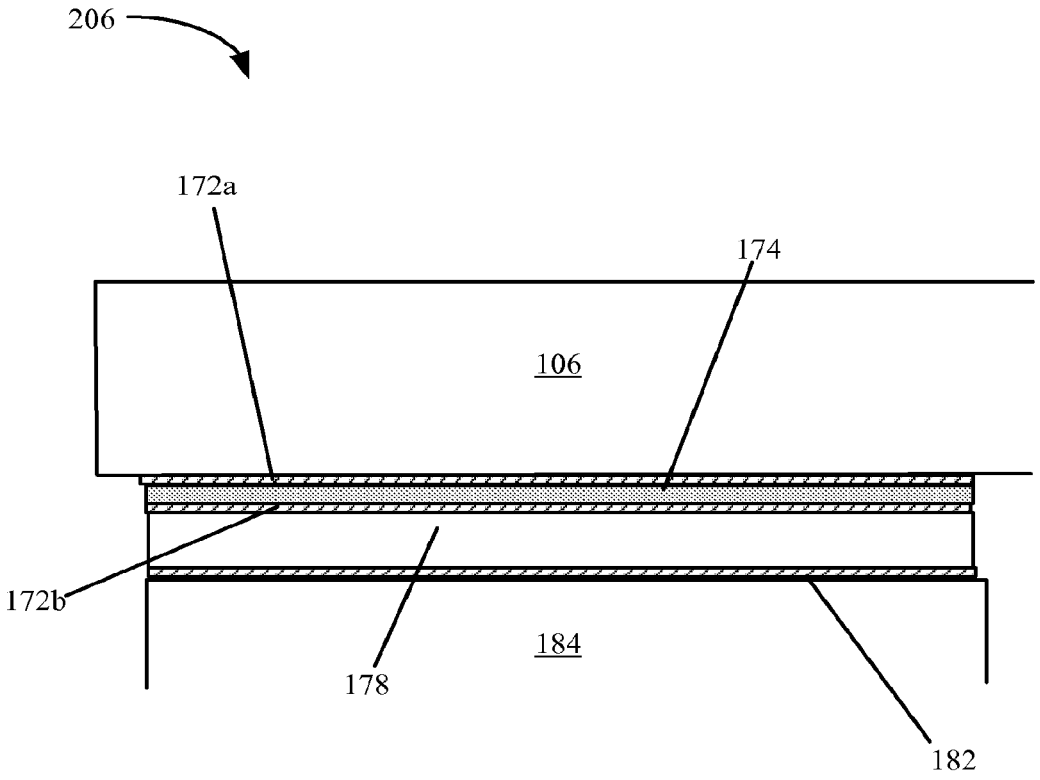

FIGS. 4A-4C show side views of antenna stack-ups allowing an antenna to be mounted to the bottom of a cover glass 106. In FIG. 4A, an antenna 174 is mounted to a first surface portion of an antenna carrier 136. The antenna 174 can be mounted to the antenna carrier 136 using an adhesive layer 172*b*, such as a PSA tape or an epoxy. In one embodiment, the antenna carrier 136 can be shaped to fit within a particular space available within the housing. For example, in one embodiment, the antenna carrier can be shaped to fit within a cavity, such as 160*a* or 160*b*, associated with the RF antenna window 132 (see FIGS. 3B and 3C).

In a particular embodiment, a piece of compressible foam 178 can be bonded to a second surface portion of the antenna carrier 136 using an adhesive layer, such as 176. The adhesive layer 176 can be formed from a bonding agent, such as a PSA tape or a liquid epoxy. After the compressible foam 178 is secured to the antenna carrier, the antenna carrier 136 can be placed within a space, such as a space within the RF antenna window 132.

In one embodiment, the adhesive layer 172*a* can be provided with a protective film (not shown) to prevent items from sticking to its top before the cover 106 is secured to the antenna stack-up 202. The cover glass 106 and the antenna 174 can be aligned with one another and the film can be removed to bond the antenna to the cover glass.

When cover 106 is lowered into place, the adhesive layer 172*a* can bond the antenna 174 to a bottom surface of the cover. The over-all stack up can be configured so that a top height of the stack-up 202 is higher than the height 177 at which the bottom of the cover 106 is secured. Thus, when the cover glass 106 is secured into place, a downward force can be exerted on the stack-up by the cover glass. The downward force can result in the foam 178 decreasing in height such that the foam exerts a force against the bottom of the cover 106.

The upward force exerted by the foam 178 can push the adhesive layer 172*a* against the bottom of the cover and can help to minimize air gaps that can form between the adhesive layer 172*a* and the cover 106. Air gaps can affect antenna performance. Thus, minimizing air gaps between the bottom of the cover 106 and the adhesive layer 172*a* can help to prevent variations in antenna performance from device to device that can result from a presence of an air gap between the antenna and the cover glass.

The compressible foams described herein can include pores and cavities often referred to as cells. Depending the structure and formulation of the cells, the cells can be described as "open cell," "semi-open cell," and "closed cell." Foam components can be used at a number of different locations within the housing. In different embodiments, the foam formulation that is used, the shape of the foam component and its thickness can vary from location to location.

The force exerted by the foam can increase significantly if the foam is compressed over a certain percentage from its original size, such as to 20% smaller or more from its original size. The compression limit where the force starts increasing significantly can be approached as all of the cells become closed as a result of the compression. The compression limit where forces starts increasing significantly after the foam is compressed beyond a certain limit can vary from foam type to foam type. However, the foam can be sized such that this limit is not reached when the cover is bonded in place over the foam.

In alternate embodiments, rather using a compressible foam or in conjunction with a compressible foam, other mechanisms can be used to push the antenna against the bottom of the cover glass or against some other desired surface to help to form a good seal. In general, there are different configurations of mechanisms that can use force generating components, such as "spring-like" elements, to accomplish this objective of pushing the antenna against the cover glass. As an example, in different embodiments, a mechanism can include the use of a cantilevered spring, a coiled geometry or gas-filled pillows. In addition, if multiple antennas are installed in this manner, the mechanism used to push the antenna a desired surface can vary from location to location.

For antenna consistency, it can be desirable to have a certain amount of force pushing against the antenna during the bonding process to the cover glass. As described above, a force generating mechanism such as a compressible foam can be used to exert the force. However, after the antenna is bonded to the cover glass and the cover glass is secured to the housing, it can be undesirable to have too much force pushing against the antenna and hence the cover glass because the force pushing on the cover via the antenna can potentially reduce the adhesion of the cover glass to the housing resulting in reliability issues.

To prevent too much force being generated after the cover glass is attached to the housing, a nominal force can be selected that accounts for variations in the force that can be generated as a result of assembly tolerances where in the worst case enough force is still provided to the antenna to meet the minimum force requirements needed to generate the desired antenna performance. In the case of foam, assembly tolerances can result in greater or smaller amounts of foam compression and hence greater or smaller amounts of force exerted by the foam on the antenna. To provide the nominal force using foam, a foam thickness can be selected where the amount of compression anticipated to be exerted on the foam is far from the over compression limit and where thickness variations in the foam resulting from assembly tolerances are small relative to the overall foam thickness.

In alternate embodiments, a force generating mechanism can be provided that exerts the nominal force on the antenna during bonding of the antenna to the cover glass but where the nominal force provided by the force generating mechanism is decreased or eliminated after the bonding of the antenna to the cover glass, such as when the cover glass is secured to the housing. As an example, mechanical snaps can be used on an antenna carrier. The mechanical snaps can be configured to push the antenna carrier and the antenna against the glass with a particular force profile, but then snap into place after the cover glass reaches its installed position. After snapping into place, the force exerted by the mechanical snaps can be reduced or eliminated.

In another example, a friction fit process could be used. An antenna carrier can be configured to interfere with a space in which it is to be installed. For instance, the antenna carrier can include a feature, such as a protuberance, a cavity or rubber gasket, that can cause interference with a surrounding space in which it is to be installed. During installation, the antenna carrier can be placed proximate to the space it is to be installed and then the cover glass can be pushed antenna and the antenna carrier. As the antenna carrier is pushed into its installed position, the friction resulting from the interference provides resistance that pushes antenna carrier and hence the antenna against the cover glass. After the antenna carrier reaches its final position, the force exerted by the antenna carrier can be reduced or eliminated.

In yet another example, a semi-rigid, yet deformable material can be placed under antenna carrier, such as a putty or wax. As the antenna carrier is pressed into the deformable material, the nominal force needed to bond the antenna to the glass can be generated. Afterward deformation, the deformable material can set in its deformed shape such that there is no (or little force) pushing against the glass after it is secured into place.

In FIG. 4B, an alternate antenna stack-up 204 is shown. In this embodiment, a proximity sensor 182 is bonded to the foam layer 178. In addition, a shielding layer 180, such as a metal shielding layer, is placed between the proximity sensor 182 and the antenna 174. In one embodiment, the shielding layer can be formed from a metal film. In this embodiment, the shielding layer may not be grounded. The shielding layer 180 can help to prevent the antenna 174 from receiving signals generated by the proximity sensor 182. In another embodiment, the shielding layer can be grounded to a metal portion of the housing.

In one embodiment, the shielding layer 180 can be disposed between the foam 178 and the antenna carrier 136 via adhesive layers 176*a* and 176*b*. In other embodiments, the shielding layer 180 can be disposed in another location. For instance, a shielding layer 180 can be built into the antenna carrier 136.

The proximity sensor can be used to detect whether an object, such as a human hand, is close to the RF antenna window 132. The portable device can be configured to supply variable amounts of power to the antenna 174 and hence, affect a strength of the signal emitted by the antenna 174. In one embodiment, when an object or surface is detected close to the proximity sensor, the portable device can be configured to reduce an amount of power supplied to the antenna 174. In another embodiment, if the device includes multiple antennas, a proximity sensor can be provided with each antenna and the amount of power supplied to each antenna can be adjusted on an antenna by antenna basis. Thus, in some embodiments, if an object is detected close to one antenna but not another of the antennas, then power can be reduced to one antenna but not the other antenna. In other embodiments, the power can be reduced to both antennas when an object is detected proximate to one or the other antenna.

In FIG. 4C, another antenna stack-up 206 is shown. In this embodiment, antenna 174 is bonded to the foam 178 via adhesive layer 172*b*. The foam 178 is then bonded to an underlying support structure 184 via adhesive layer 182. The foam 178 can help to generate a good seal with a minimal air gap between the antenna 174 and the cover 106. As is described in more detail with respect to FIGS. 6A and 6B, an antenna and foam stack-up, such as 206, can be bonded to a speaker assembly.

Figure 6B:
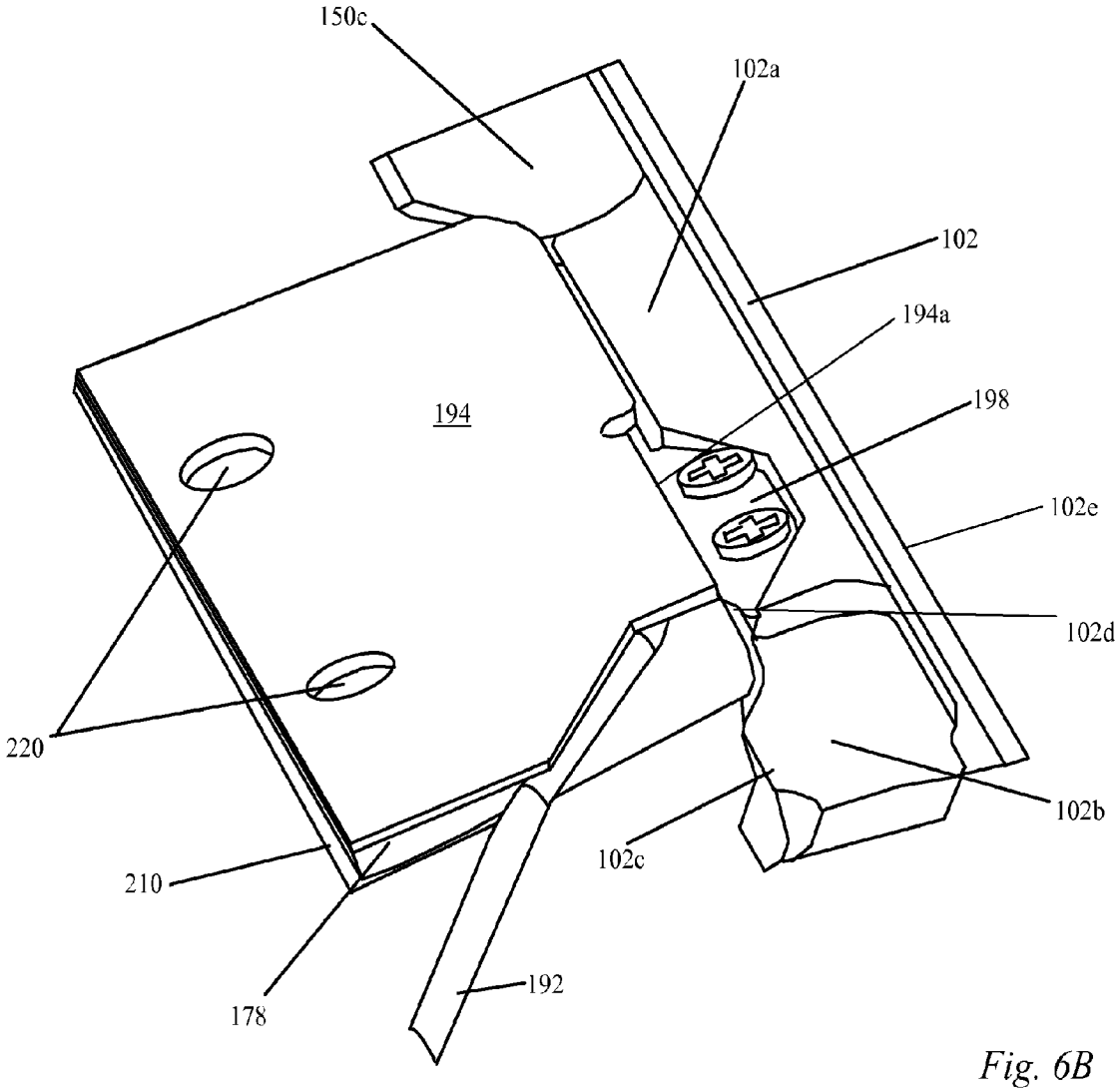

With respect to FIGS. 5, 6A and 6B, an antenna stack-up configuration is described where the an antenna is secured to the bottom a cover glass close to where the cover glass attaches to the housing. Therefore, with respect to FIG. 5, mounting the cover glass to the housing is described in general. When an antenna is mounted close to where the cover glass is attached to the housing, the housing and the apparatus for attaching the cover glass to the housing can be modified. In a particular embodiment, details of these modifications are described with respect to FIGS. 6A and 6B.

FIG. 5 shows a side view of a stack-up 208 for bonding a cover 106 to the housing 102. The housing 102 can include a surface for receiving a trim bead 108. The trim bead 108 can be mounted to the housing an adhesive layer, such as 188*a*. In one embodiment, the trim bead 108 can be disposed around an outer perimeter of the housing 102. In the embodiment where an antenna window is used, a portion of the trim bead 108 can extend over the antenna window. The cover 106 can be bonded to the trim bead 108 via an adhesive layer, such as 188*b*. When the cover 106 is installed it can enclose underlying structures, such as 190, which can be associated with various device components.

FIG. 6A shows a perspective views an antenna stack-up located near an outer edge of the housing 102. In one embodiment, the antenna 194 can be part of an antenna stack-up including a compressible foam material as was described above with respect to FIG. 4C. In one embodiment, the antenna stack-up can be mounted to a speaker assembly 210. The antenna can include alignment holes 220 that can be used to align the antenna 194 to the cover glass. The antenna 194 can be coupled to a wire 192 that allows information to be transferred between the antenna and a logic board, such as the main logic board on the device. The information can be related to signals received by the antenna 194 or signals to be broadcast by the antenna. In one embodiment, the antenna 194 can be used to implement a wireless protocol, such as Wi-Fi.

To improve wireless performance, it can be desirable to place the antenna close to an edge of the housing. If the housing is formed from a radio opaque material, such as a metal, to improve antenna performance, it can be desirable to thin the housing 102 as much as possible proximate to the antenna while maintaining a relatively uniform thickness of metal next to the antenna. In FIG. 6A, an antenna 194 is mounted close to one edge of the housing between corner bracket 150*c* and support bracket 152 on the housing 102 (see FIG. 3B). In other embodiments, the antenna 194 can be mounted at other locations proximate to the housing. Further, the antenna 194 can be mounted on top a speaker assembly or on top of some other internal structure. Thus, this example is provided for the purposes of illustration only and is not meant to be limiting.

In FIG. 6A, the trim bead 108 includes a cut-out portion. The cut-out portion allows a grounding tab 198 to be grounded to the housing 102 next the antenna 194. The grounding tab 198 can be secured to the housing 102 via one or more fasteners, such as fasteners 196. In one embodiment, a cover layer (not shown) can be placed over the fasteners after the grounding tab 198 is secured to the housing. As described above, to improve antenna performance, it can be desirable to thin the housing 102 proximate to the antenna 194. This feature is illustrated with as follows with respect to FIG. 6B.

In FIG. 6B, the support bracket 152 is removed to show the underlying structure of the housing. The housing 102 includes a ledge 102*a* for receiving the trim bead 108. Next, to ledge 102*a*, another ledge 102*b* is located. The ledge 102*b* is configured to receive the support bracket 152 shown in FIG. 6A. The ledge 102*b* is located below ledge 102*a* so that, when the support bracket 152 is resting on the ledge 102*b*, the top of the support bracket is about the same height as ledge 102*a*. Then, the trim bead 108 can rest across the top surfaces of bracket 150*c*, bracket 152 and ledge 102*a*.

In FIG. 6B, the distance between side 194*a* and an exterior edge of housing is approximately the distance between locations 102*d* and 102*e* on the housing. The distance is proximately the thickness of the housing at this location. Alongside 194*a* of the antenna 194, the thickness of the housing is relatively constant and is proximately the thickness of the housing between locations 102*d* and 102*e*. In FIG. 6B, it can be seen at location 102*c* on ledge 102*b* that the housing is thicker at this location relative to the thickness of the housing along 194*a*, i.e., location 102*d* is closer to the edge of the housing than location 102*c*. As described above, providing a relatively thinner housing with a constant thickness proximate to the antenna may help to improve the antenna performance.

Figure 7:
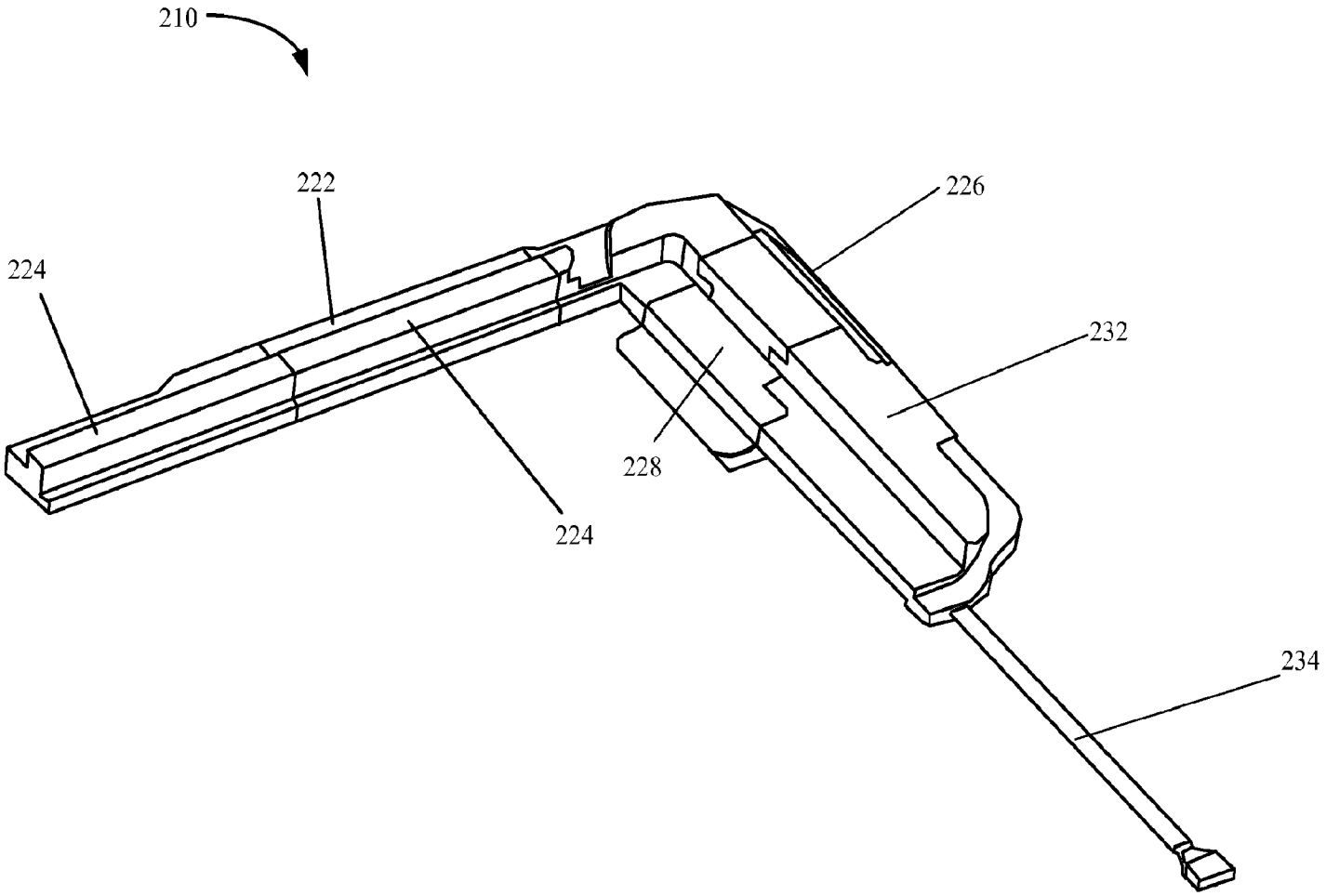
FIG. 7 is a perspective view of a speaker assembly in accordance with the described embodiments.

FIG. 7 is a perspective view of a speaker assembly 210. As described above, in one embodiment, an antenna stack-up can be mounted on top of the speaker assembly 210. For example, the antenna can be mounted to the speaker assembly proximately at location 232. The speaker assembly 210 can include a housing 224 and a connector 234 that allows the speaker to receive signals that are converted into sound. The housing 224 can enclose one or more speaker drivers. In one embodiment, the housing 224 can enclose two speaker drivers.

One concern with mounting an antenna, such as 194 in FIG. 6A, is that magnets in the speaker drivers can generate EMI that can affect the antenna performance. In one embodiment, to mitigate potential EMI from the speaker drivers, each of the drivers can be grounded to a metal portion of the housing 224. For instance, a first driver can be grounded to metal portion 222 in housing 224 and a second driver can be grounded to a metal portion 226 in housing 224. Then, a conductive material, such as a conductive tape, can be coupled to each of the metal portions and wrapped around the housing 224, such that a faraday cage is formed around each speaker driver. For example, conductive tape 234 is coupled to the metal portion 222 and wrapped around the housing 224 and conductive tape 228 is coupled to the metal portion 226 and wrapped around housing 224. Thus, a faraday cage is formed around each of the two drivers. Finally, the conductive tape used to form the faraday cage, such as 224 and 228, can be grounded to the housing.

In addition, the use of conductive tape can provide other advantages. For instance, the speaker assembly can include metal components that vary in size, shape and their installed position within the assembly. These variations can affect antenna performance depending on where the antenna is installed relative to the metal components. The conductive tape can provide a constant ground plane between the antenna and the metal components that can help mitigate any effects resulting from variations in the size, shape and position of the metal components of the speaker assembly relative to the antenna. Another example potential advantage of using conductive tap is that the conductive tape can be used to fill gaps and openings between metal objects that can resonate at radio frequencies that reduce antenna performance.

As noted above, grounding can be important for maintaining consistent antenna performance. In addition, other components can be sensitive to EMI and a good grounding scheme can help to mitigate EMI issues. One component that can be sensitive to EMI is a touch panel, such as a capacitive touch sensor. The touch panel can be located over a display module, such as a display module including an LCD display. A few details in regards to grounding the display module to mitigate EMI issues associated with the proximity of the touch panel to the display module as well as grounding the display module to mitigate EMI issues associated with the proximity of the display module to the one or more antennas is described in more detail as follows.

To meet overall thickness objective for the portable computing device, it can be desirable to minimize the thickness of various device components. For example, a display module without a front bezel can used to make the display module thinner. As another example, for a portable device with a touch panel, the touch panel can be placed relatively close to display components associated with the display module, such as an LCD glass associated with an LCD display. In a particular embodiment, a touch panel layer can be located less 1 mm in distance from an EMI generating layer in the display module. The EMI generating layer or layers in a display module can vary depending on the display technology that is utilized and the example of an LCD glass is provided for the purposes of illustration only.

As noted above, the EMI generating layer or layers in the display module can be grounded to mitigate EMT effects on the touch panel. In the case of the display module, it is desirable to perform this grounding while not increasing or at least adding a minimum amount of the thickness to the display module. Towards this objective, in one embodiment, a conductive tape can be used to ground the EMI generating display circuitry within the display module to a metal portion of the display module housing, such as grounding thin-film traces on an LCD glass to the metal portion of the housing. In a particular embodiment, the thin-film traces can be ITO traces.

The conductive tape can be less than 0.1 mm thick. In a particular embodiment, the conductive tape can be about 0.06 mm thick. The conductive tape can use an adhesive that does not corrode or damage in any manner the substrate to which it is bonded, such as a thin film formed on an LCD glass. The conductive tape can be formed with a color that is cosmetically acceptable. For example, in one embodiment, a visible portion of the conductive tape can be a "black" color.

Figure 8:
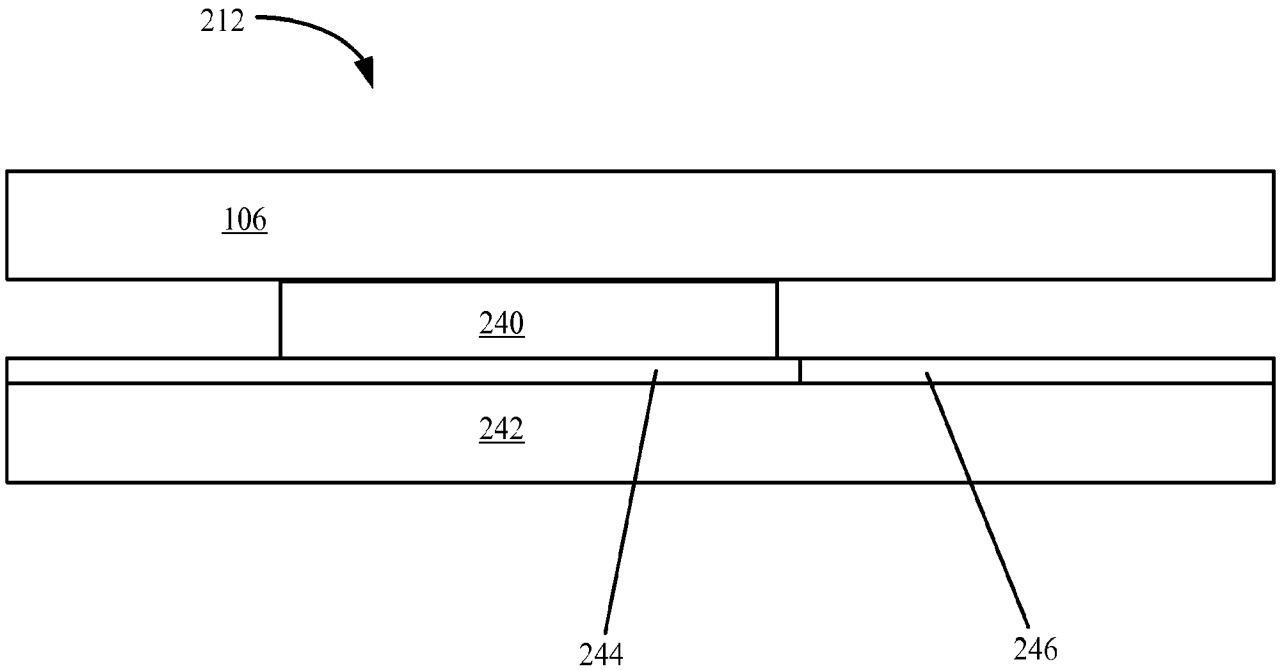
FIG. 8 shows a side view of a display stack-up in accordance with the described embodiments.

An embodiment of a grounding scheme for a display module is described as follows. FIG. 8 shows a side view of a stack-up 212 for providing imaging services and touch recognition capabilities. The display module 242 can be disposed beneath the cover glass 106. A touch panel 246 can be located above the display module 242. A layer of conductive tape 244 can be provided to ground EMI generating display circuitry in the display module 242, such as a thin film with circuit traces on an LCD glass, that can affect the touch panel 246. In one embodiment, a dust shield layer 240 can be disposed above the conductive tape 244 and beneath the cover 106.

In a particular embodiment, one end the conductive tape 244 can be coupled to one or more layers of the EMI generating display circuitry in the display module 242, such as a film with circuit traces on an LCD glass. Then, the conductive tape 244 can be attached to a metal portion of a housing for the display module 242. For instance, if the metal portion of the housing extends up the sides of the display module 242, then the conductive tape can be extended over a top of the display 244 and partially around the side and attached to the metal portion on the side. If the metal portion is on the bottom portion of the display module 242 and does not extend around the sides, then the conductive tape can be extended over a top of the display 244, around the side and partially onto the bottom portion of the display module. One advantage of using a conductive tape layer, such as 244, is that it may be thinner than using a corresponding metal structure for grounding purposes.

To control interference and antenna resonances between the display circuitry associated with the display module 242 and one or more antennas, the metal chassis of the display module can be grounded to the antenna's ground plane. In one embodiment, this grounding can be accomplished by cutting slits in the conductive tape associated with the display module 242, such as 244, adhering a conductive foam to the display module 242 proximate to the slits and then the compressing the foam into a gap where the foam can contact a conductive surface associated with the antenna's ground plane. The foam can be compressed in this manner during the installation of the display module 242. In a particular embodiments, foam can be used at multiple locations to ensure good grounding between the display module and the antenna ground plane.

Figure 9A:
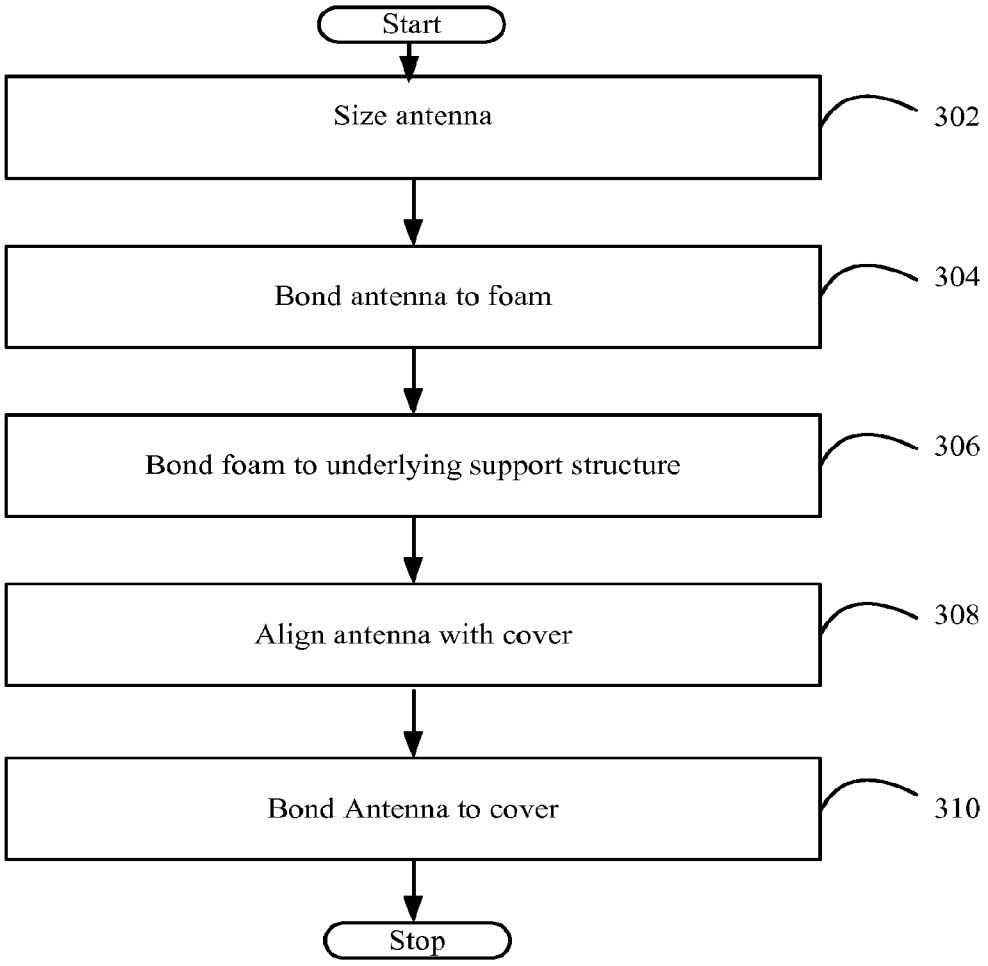
FIGS. 9A and 9B show methods of generating an antenna stack-up for a portable device in accordance with the described embodiments.

FIG. 9A shows a method of generating an antenna stack-up for a portable device. In 302, a shape and a size of the antenna can be determined. The shape and size can be based upon such factors as packaging restrictions and wireless performance considerations. In 304, the antenna can be bonded to a compressible foam. A bonding agent, such as a pressure sensitive adhesive (PSA), can be used to bond to the antenna to the foam. In 306, the foam can be bonded to an underlying support structure. In one embodiment, previously described with respect to FIG. 4C, the foam can be bonded to the support structure associated with a speaker assembly.

In 308, the antenna can be aligned with a cover, such as a cover glass for the portable electronic device. The cover glass can be both transparent to visible light and radio waves. In one embodiment, the antenna assembly can include alignment holes for receiving alignment points on the cover. The cover glass and the antenna can be aligned as part of bonding the cover to the housing. In 310, the antenna can be bonded to the cover. The antenna can be bonded to the cover using an adhesive, such as a PSA tape.

When the antenna is placed against the cover, the foam can be sized such that the foam is compressed. The compression of the foam can exert a force that presses the antenna against the bottom of the cover. The pressure exerted by the foam can help to form a good seal between the cover and the antenna, such as a seal where the air gaps between the antenna and the cover are minimized and relatively constant across the interface between the antenna and the cover, i.e., air bubbles that affect antenna performance are minimized.

The force exerted by the foam can increase significantly if the foam is compressed over a certain percentage from its original size, such as to 20% smaller or more from its original size. The limit can be reached when all the open cells of the foam are compressed. The compression limit where forces starts increasing significantly after the foam is compressed beyond a certain limit can vary from foam type to foam type. However, the foam can be sized such that this limit is not reached when the cover is bonded in place over the foam.

Figure 9B:
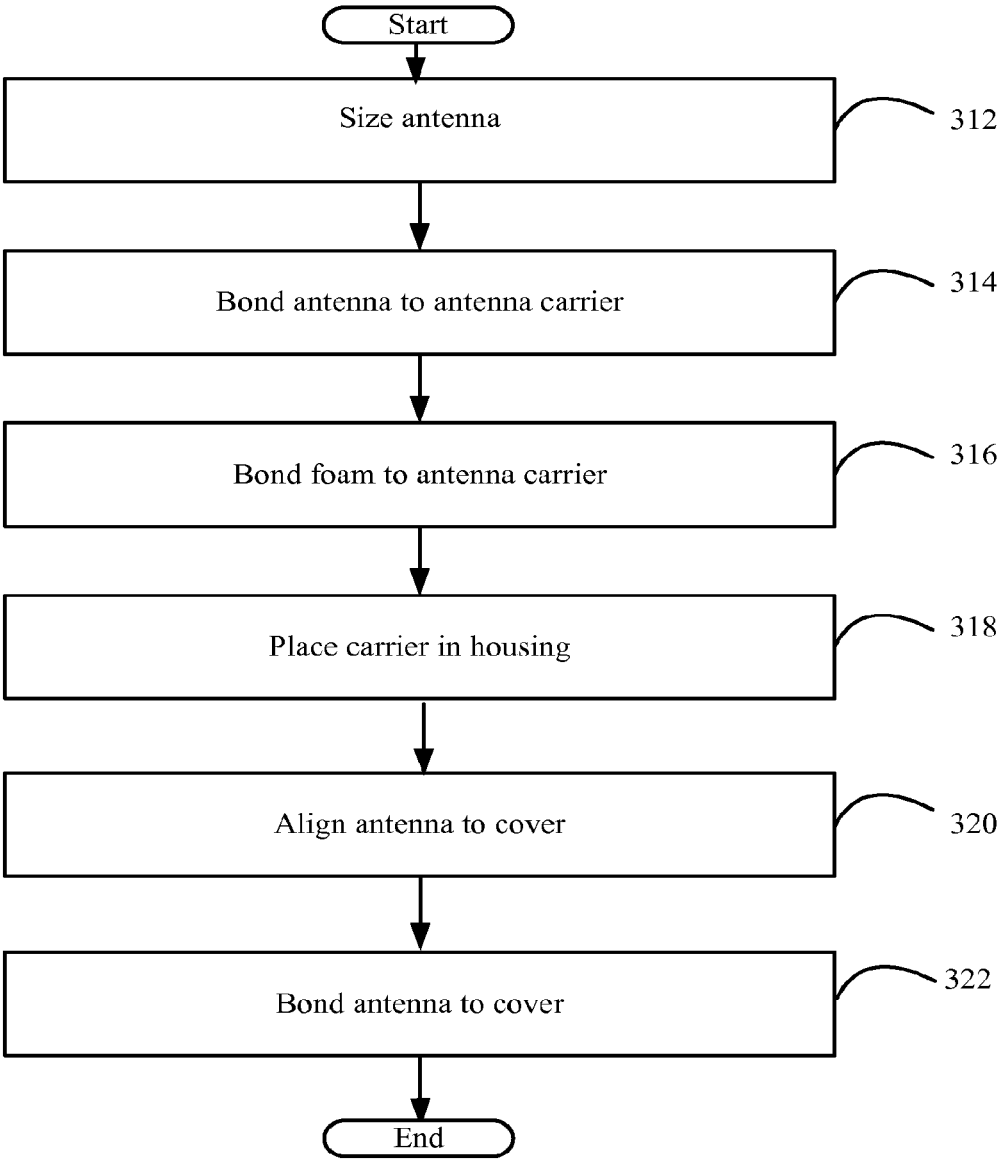

FIG. 9B shows another embodiment of a method of generating an antenna stack-up for a portable device. In 312, the antenna can be sized and shaped. In 314, the antenna can be bonded to one side of an antenna carrier (e.g., see 136 in FIGS. 4A and 4B). The shape of the antenna can be varied. Typically, the shape can be selected to fit within some space specified within the housing where the specified shape can be varied.

In 314, the antenna can be bonded to one surface portion of the antenna carrier. In 316, a compressible foam, such as an open cell foam, can be bonded to another surface portion of the antenna carrier. In one embodiment (see FIG. 4B), a component such as a proximity sensor and a shield material can be bonded to compressible foam. The shield material can shield the antenna from EMI generated by the component. In 316, the antenna carrier including the antenna can be placed within the housing, such as within a cavity associated with an RF antenna window. In 320, the antenna can be aligned with a cover glass and then, in 322, the antenna can be bonded to cover glass. When cover glass is secured into position, the foam can be compressed such that a force is exerted through the antenna carrier that presses the antenna against the cover. Again, the force exerted by the foam can improve the sealing between the antenna and the cover, such as by minimizing the air gaps. Minimizing the air gaps can limit variations in wireless performance from device to device that can result from having air gaps that vary from device to device. Large variations in wireless performance from device to device can be undesirable.

Figure 10:
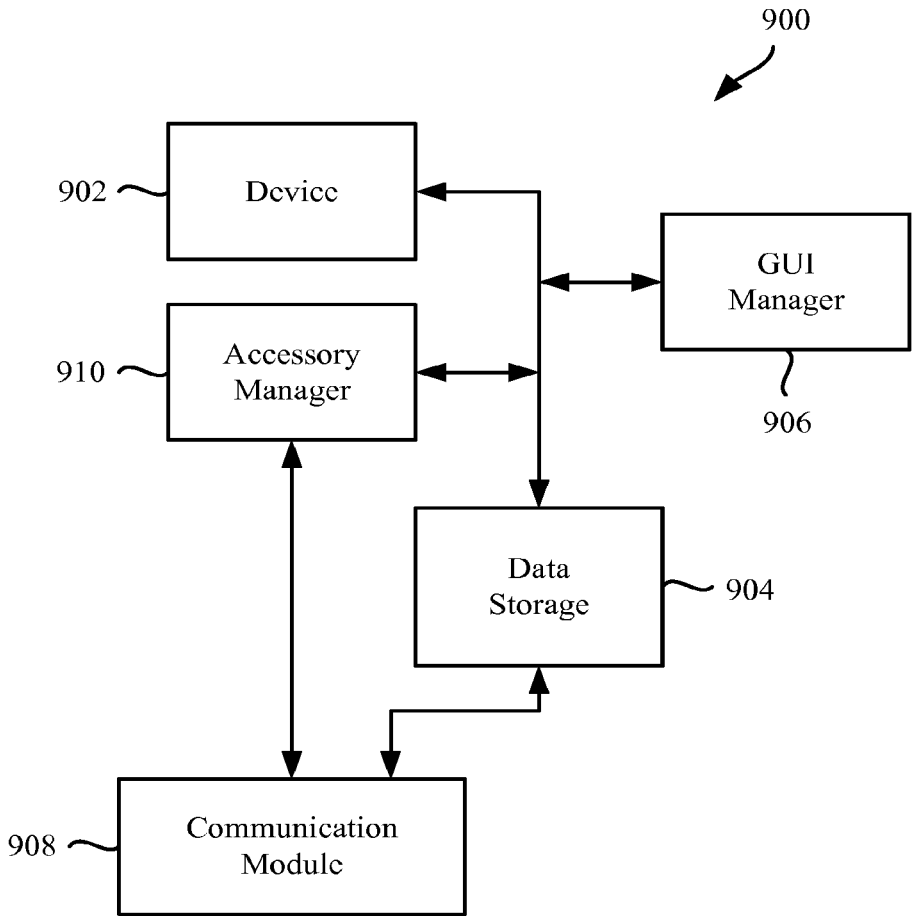
FIG. 10 is a block diagram of an arrangement of functional modules utilized by a portable electronic device in accordance with the described embodiments.

FIG. 10 is a block diagram of an arrangement 900 of functional modules utilized by an electronic device. The electronic device can, for example, be tablet device 100. The arrangement 900 includes an electronic device 902 that is able to output media for a user of the portable media device but also store and retrieve data with respect to data storage 904. The arrangement 900 also includes a graphical user interface (GUI) manager 906. The GUI manager 906 operates to control information being provided to and displayed on a display device. The arrangement 900 also includes a communication module 908 that facilitates communication between the portable media device and an accessory device. Still further, the arrangement 900 includes an accessory manager 910 that operates to authenticate and acquire data from an accessory device that can be coupled to the portable media device.

Figure 11:
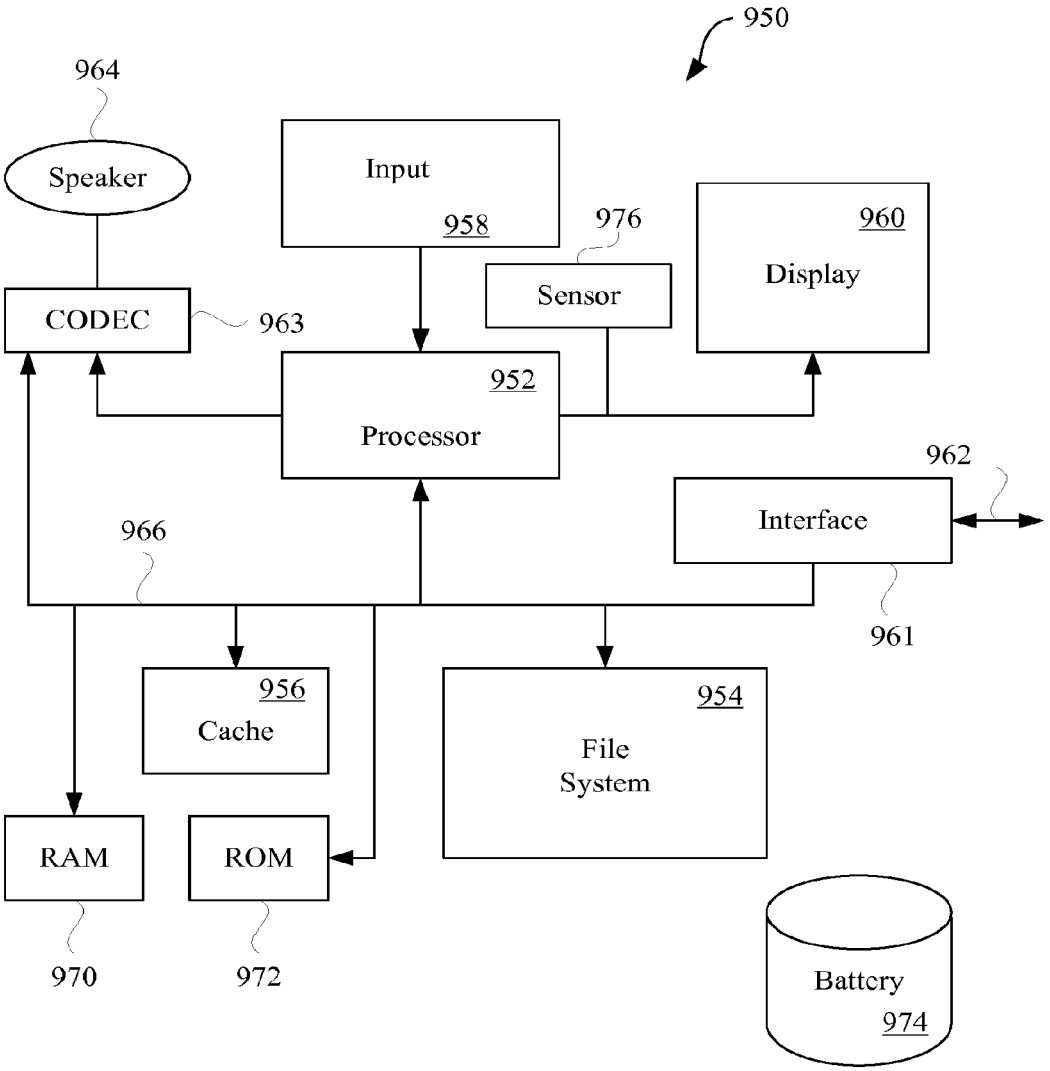
FIG. 11 is a block diagram of an electronic device suitable for use with the described embodiments.

FIG. 11 is a block diagram of a electronic device 950 suitable for use with the described embodiments. The electronic device 950 illustrates circuitry of a representative portable media device. The electronic device 950 can include a processor 952 that pertains to a microprocessor or controller for controlling the overall operation of the electronic device 950. The electronic device 950 can be configured to store media data pertaining to media items in a file system 954 and a cache 956. The file system 954 can be implemented using a memory device, such as a storage disk, a plurality of disks or solid-state memory, such as flash memory.

The file system 954 typically can be configured to provide high capacity storage capability for the electronic device 950. However, to improve the access time to the file system 954, the electronic device 950 can also include a cache 956. As an example, the cache 956 can be a Random-Access Memory (RAM) provided by semiconductor memory. The relative access time to the cache 956, such as a RAM cache, can be substantially shorter than for other memories, such as flash or disk memory. The cache 956 and the file system 954 may be used in combination because the cache 956 may not have the large storage capacity of the file system 954 as well as non-volatile storage capabilities provided by the memory device hosting the file system 954.

Another advantage of using a cache 956 in combination with the file system 954 is that the file system 954, when active, consumes more power than does the cache 956. The use of cache 956 may decrease the active time of the file system 954 and hence reduce the overall power consumed by the electronic device. The power consumption is often a concern when the electronic device 950 is a portable media device that is powered by a battery 974.

The electronic device 950 can also include other types of memory devices. For instance, the electronic device 950 can also include a RAM 970 and a Read-Only Memory (ROM) 972. In particular embodiments, the ROM 972 can store programs, utilities or processes to be executed in a non-volatile manner. The RAM 970 can be used to provide volatile data storage, such as for the cache 956.

The electronic device 950 can include one or more user input devices, such as input 958 that allow a user of the electronic device 950 to interact with the electronic device 950. The input devices, such as 958, can take a variety of forms, such as a button, keypad, dial, touch screen, audio input interface, video/image capture input interface, input in the form of sensor data, etc. Still further, the electronic device 950 includes a display 960 (screen display) that can be controlled by the processor 952 to display information to the user. A data bus 966 can facilitate data transfer between at least the file system 954, the cache 956, the processor 952, and the CODEC 963.

In one embodiment, the electronic device 950 serves to store a plurality of media items (e.g., songs, podcasts, image files and video files, etc.) in the file system 954. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or video content.

When a user desires to have the electronic device play a particular media item, a list of available media items is displayed on the display 960. Then, using the one or more user input devices, such as 958, a user can select one of the available media items. The processor 952, upon receiving a selection of a particular media item, supplies the media data (e.g., audio file) for the particular media item to one or more coder/decoders (CODEC), such as 963. The CODECs, such as 963, can be configured to produce output signals for an output device, such as speaker 964 or display 960. The speaker 964 can be a speaker internal to the media player 950 or external to the electronic device 950. For example, headphones or earphones that connect to the electronic device 950 would be considered an external speaker.

The electronic device 950 can be configured to execute a number of applications besides media playback applications. For instance, the electronic device 950 can be configured execute communication applications, such as voice, text, e-mail or video conferencing applications, gaming applications, web browsing applications as well as many other different types of applications. A user can select one or more applications for execution on the electronic device 950 using the input devices, such as 958.

The electronic device 950 can include an interface 961 that couples to a data link 962. The data link 962 allows the electronic device 950 to couple to a host computer or to accessory devices. The data link 962 can be provided over a wired connection or a wireless connection. In the case of a wireless connection, the interface 961 can include a wireless transceiver. Sensor 976 can take the form of circuitry for detecting any number of stimuli. For example, sensor 976 can include a Hall Effect sensor responsive to external magnetic field, an audio sensor, a light sensor such as a photometer, a gyroscope, and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. For example, although an extrusion process is preferred method of manufacturing the integral tube, it should be noted that this is not a limitation and that other manufacturing methods can be used (e.g., injection molding). It is therefore intended that the following appended claims be interpreted as including all such alterations, permutations, and equivalents as fall within the true spirit and scope of the described embodiments.

The invention claimed is:

1. A system comprising:

a metal housing including a surface for receiving a cover glass;

a speaker assembly including:

a speaker housing having at least one metal portion for enclosing at least one speaker driver;

a connector for grounding the at least one speaker driver to the at least one metal portion of the speaker housing;

a conductive material wrapped around the speaker housing for forming a faraday cage around the at least one speaker driver, the conductive material grounded to the at least one metal portion and the metal housing; and an antenna system mounted to a bottom of the cover glass and to the speaker assembly and grounded to the metal housing.

2. The system of claim 1, wherein metal housing is an aluminum housing.

3. The system of claim 1, further comprising:

a compressible layer of foam coupled to the antenna system wherein the compressible foam layer is configured to exert an upward force to the antenna system to provide a relatively constant spacing between the antenna system and a bottom of the cover glass and to minimize air gaps between the bottom of the cover glass and the antenna system.

4. The system of claim 1, further comprising:

a display module and a touch panel disposed between the display module and the cover glass, the display module including one or more EMI generating layers wherein the EMI generating layers are grounded to a metal portion of a display module housing using a conductive tape to help to mitigate an effect of the EMI generating layers of the touch panel.

5. The system of claim 1, further comprising:

a trim bead disposed between the metal housing and the cover glass; and a grounding tab coupled to the antenna system wherein a portion of the trim bead is removed surrounding where the grounding tab is coupled to the metal housing.

6. The system of claim 1, wherein the antenna system is configured to support a wireless protocol selected from the group consisting of Wi-Fi, GSM, and CDMA.

7. The system of claim 1, wherein the conductive material comprises conductive tape.

8. The system of claim 1, wherein the speaker housing encloses at least one additional speaker driver and has at least one additional metal portion.

9. The system of claim 8, further comprising at least one additional connector for grounding the at least one additional speaker driver to the at least one additional metal portion.

10. The system of claim 8, wherein the conductive material is also grounded to the at least one additional metal portion.

11. The system of claim 8, wherein the conductive material also forms the faraday cage around the at least one additional speaker driver.

12. The system of claim 1, wherein the conductive material provides a constant ground plane between the antenna system and at least one metal component of the speaker assembly.

13. The system of claim 12, wherein the conductive material mitigates effects resulting from sizes, shapes, or positions of the at least one metal component of the speaker assembly.

14. The system of claim 1, wherein the conductive material fills at least one gap between the antenna system and at least one metal component of the speaker assembly that can resonate one or more radio frequencies.

15. A portable computing device comprising:

a metal housing including a surface coupled to a cover;

a speaker assembly including:

a speaker housing that encloses a speaker;

a connector that grounds the speaker to the speaker housing;

a faraday cage formed around the speaker that is grounded to the speaker housing and the metal housing; and an antenna system mounted to the cover that is grounded to the metal housing.

16. The portable computing device of claim 15, wherein the metal housing is radio opaque and the cover is radio transparent.

17. The portable computing device of claim 15, wherein the metal housing comprises a single piece metal housing.

18. The portable computing device of claim 15, further comprising a gasket between the surface and the cover.

19. The portable computing device of claim 15, wherein the metal housing comprises aluminum or stainless steel.

20. The portable computing device of claim 15, wherein the metal housing defines an opening to which the speaker assembly is coupled.

* * * * *